US007192209B2

(12) United States Patent
Otsuka et al.

(10) Patent No.: US 7,192,209 B2
(45) Date of Patent: Mar. 20, 2007

(54) PRINTING APPARATUS WITH SLIDING PANELS ENABLING EXTRACTION OF MEDIUM FROM TRANSPORT PATH

(75) Inventors: Yasuhiro Otsuka, Kanagawa (JP); Shinji Seto, Kanagawa (JP); Kohei Murakami, Kanagawa (JP); Fuminori Takizawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 78 days.

(21) Appl. No.: 10/945,116

(22) Filed: Sep. 21, 2004

(65) Prior Publication Data

US 2005/0062827 A1 Mar. 24, 2005

(30) Foreign Application Priority Data

Sep. 24, 2003 (JP) ..... 2003-331536

(51) Int. Cl.

| | |
|---|---|
| ***B41J 13/00*** | (2006.01) |
| ***B41J 29/00*** | (2006.01) |
| ***B41J 29/02*** | (2006.01) |
| *B41J 13/10* | (2006.01) |

(52) U.S. Cl. ..... 400/605; 400/693; 347/104; 347/108

(58) Field of Classification Search ..... None
See application file for complete search history.

(56) References Cited

U.S. PATENT DOCUMENTS

| | | | | |
|---|---|---|---|---|
| 5,785,308 | A * | 7/1998 | Flores et al. | 271/9.11 |
| 6,305,858 | B1 * | 10/2001 | Mugrauer | 400/625 |
| 6,474,806 | B2 * | 11/2002 | Terauchi et al. | 347/104 |
| 6,758,541 | B2 * | 7/2004 | Hashimoto | 347/5 |
| 2004/0101328 | A1 * | 5/2004 | Kimura et al. | 399/111 |

FOREIGN PATENT DOCUMENTS

| | | | |
|---|---|---|---|
| JP | A 11-348385 | | 12/1999 |
| JP | 2000281264 | A * | 10/2000 |
| JP | A 2002-103735 | | 4/2002 |
| JP | 2002160411 | A * | 6/2002 |
| JP | A 2002-219796 | | 8/2002 |

* cited by examiner

*Primary Examiner*—Daniel J. Colilla
(74) *Attorney, Agent, or Firm*—Morgan, Lewis & Bockius, LLP

(57) ABSTRACT

At a printing unit which structures a printing apparatus, a portion of a transport path, which portion includes a rear portion of an upper guide path portion of a printing guide path, a sub-scanning guide path, a paper ejection buffer and a front portion of a branching guide path, is assembled to an upper face side of a sliding panel together with a printing section and a separation and ejection roller which are assembled to the upper face side of the sliding panel. The sliding panel is attached to a casing of the printing unit with a pair of guide rails interposed therebetween at a front end portion and a rear end portion. By sliding of this sliding panel, the portion of the transport path can be slid along a direction substantially intersecting a direction in which the transport path extends.

3 Claims, 15 Drawing Sheets

PRINTING APPARATUS WITH SLIDING PANELS ENABLING EXTRACTION OF MEDIUM FROM TRANSPORT PATH

CROSS-REFERENCE TO RELATED APPLICATION

This application claims priority under 35 USC 119 from Japanese Patent Application No. 2003-331536, the disclosure of which is incorporated by reference herein.

BACKGROUND OF THE INVENTION

1. Technical Field

The present invention relates to a printing apparatus which supplies recording mediums to a plurality of printing sections, which are arranged in a vertical direction, and parallel-processes image recording on a plurality of the recording mediums by operating in a parallel manner.

2. Description of the Related Art

A printing apparatus of a parallel processing type is disclosed in, for example, Japanese Patent Application Laid-Open (JP-A) No. 2002-103735. This printing apparatus realizes high-speed printing in cases of creating large volumes of printed material and the like by a plurality of printing units being disposed in parallel, a print job being shared between these printing units, and these printing units being operated in a parallel manner.

The printing apparatus disclosed in JP-A No. 2002-103735 includes a printing unit and a base unit, and is structured by stacking or more of the printing unit on the base unit. The base unit is structured by a paper ejection section which ejects printed recording paper that has been conveyed from the printing unit, a paper supply section which stores recording paper and supplies this recording paper to the printing unit, and a control section.

Each printing unit in JP-A No. 2002-103735 features a printing section (printing portion), a first paper supply portion (first paper supply path), a second paper supply portion (second paper supply path), a first paper ejection portion (first paper ejection path) and a second paper ejection portion (second paper ejection path). The printing section is structured by an inkjet head or the like which implements printing on the recording paper. The first paper supply portion supplies recording paper which has been fed in through a feeding aperture to the printing section. The second paper supply portion supplies recording paper which has been fed in through the feeding aperture to a printing unit at another level. The first paper ejection portion ejects recording paper which has been printed on at the printing section to an ejection aperture. The second paper ejection portion ejects recording paper which has been printed on by a printing unit at another level to the ejection aperture.

In the printing apparatus of JP-A No. 2002-103735, the ejection aperture of the printing unit at the lowest level communicates with the paper ejection section of the base unit, and the feeding aperture of that printing unit communicates with the paper supply section of the base unit. Between printing units at adjacent levels, the second paper supply path and the second paper ejection path of the printing unit at the lower side communicate with the feeding aperture and the ejection aperture, respectively, of the printing unit at the upper side. Thus, in this printing apparatus, the second paper supply paths of the respective printing units are connected to structure a single paper supply course for guiding the recording paper from the paper supply section to the respective printing units, and the second paper ejection paths of the respective printing units are connected to structure a single paper ejection course for guiding the recording paper from the respective printing units to the paper ejection section. Therefore, recording paper that has been supplied along the paper supply course, into which the respective second paper supply paths are connected, from the paper supply section of the base unit to an arbitrary printing unit can be supplied to the printing section of the arbitrary printing unit by the first paper supply path thereof. Further, the recording paper that has been printed by this printing section is fed out along the first paper ejection path to the second paper ejection path, and this recording paper is ejected along the paper ejection course, into which the respective second paper ejection paths are connected, to the paper ejection section of the base unit.

Now, JP-A No. 2002-103735 does not include any descriptions concerning dealing with cases in which paper blockages (jams) occur in the printing apparatus. For example, in a case in which jammed recording paper is disposed in the paper supply course or paper ejection course described above so as to straddle between two printing units, if one of the printing units is pulled out forward relative to the other printing unit in order to remove the jammed recording paper, the recording paper will be torn and removal of a torn-off piece of the paper that is left in the other printing unit will be difficult. Furthermore, with a recording medium which is resistant to tearing, such as an OHP sheet or the like, when a printing unit is pulled out, a tensile force will be applied through the recording medium to both the printing units, and there may be damage to the interiors of the printing units, the printing sections, and the like.

In contrast, in a printing apparatus (inkjet-system recording device) disclosed in JP-A No. 2002-219796, a plurality of unit-form recording sections are provided with recording portions including inkjet heads which discharge ink. The unit-form recording sections are provided stacked in a vertical direction. At a side portion of each unit-form recording section, an opening portion is formed for performance of maintenance operations on the respective unit-form recording sections, such as replacing ink tanks, loading recording mediums and the like. Each opening portion can be opened and closed by an opening/closing lid. Hence, a user, service engineer or the like puts the opening/closing lid into an opened state to perform printing apparatus maintenance operations from a side face side of the unit-form recording section.

However, at the printing apparatus of JP-A No. 2002-219796, in, for example, a case of extracting jammed recording paper from an inward side (the side of a side portion of the unit-form recording section which is at a side opposite to the side portion thereof at which the opening portion is formed) relative to a printing section (an inkjet head), it is necessary for a user or the like to insert a hand through the opening portion and deep into the unit-form recording section to find and pull out the recording paper, and this operation is difficult. Obviously, if the recording paper is torn at this time, removal of a torn-off piece of paper that is left in the unit-form recording section will be more difficult. Furthermore, even for maintenance operations such as replacing ink tanks and the like, it is necessary for a user or the like to insert a hand through the opening portion into the unit-form recording section. Thus, operability is poor.

In JP-A No. 11-348385, a printing apparatus (an array-type printer) is disclosed in which a plurality of image-forming sections are provided in parallel at a printer main body and are operated in parallel. In this printing apparatus, the image-forming sections have a structure which can be mounted at and removed from the printer main body. Consequently, supplies loading operations and maintenance operations, such as loading toner for development, clearing recording paper feeding jams (paper blockages), cleaning the machine interior and the like, can be carried out more easily.

However, for this printing apparatus of JP-A No. 11-348385, there are no descriptions concerning dealing with paper blockages that occur in a paper supply/feeding portion (a paper supply path) which is for feeding recording paper from a paper supply section, which is disposed at a lower portion of the printer main body, to the respective image-forming portions. Furthermore, in a case of extracting, for example, jammed recording paper that has stopped in the paper supply/feeding portion of the printer main body at a vicinity of a paper supply aperture of an image-forming portion (at a feed roller disposed near a paper supply connector), it will be necessary for a user or the like to take out the image-forming section from the printer main body and then insert a hand deep into a portion for mounting the image-forming section in the printer main body (a cavity portion) to find and pull out the recording paper, and this operation is difficult. Furthermore, for recording paper which has jammed inside an image-forming section, a specific method of removal is not described in JP-A No. 11-348385. To extract, for example, jammed recording paper which is completely accommodated inside an image-forming section at a vicinity of a paper ejection aperture of the image-forming section (a feed roller which is disposed near the paper ejection aperture), it is thought that it will be necessary to dismantle the image-forming section.

Further still, with the printing apparatus of JP-A No. 11-348385, in a case in which, for example, recording paper that is fed out from the respective image-forming sections is desired to be ejected to an accumulation ejection portion provided at an upper portion of the printer main body, or at a lower portion of the printer main body as in the printing apparatus of JP-A No. 2002-103735, a paper ejection path is provided extending in a vertical direction at a recording paper ejection direction side portion of each image-forming section. Hence, it is capable of ejecting to the upper portion or lower portion. However, in such a case, similarly to the printing apparatus of JP-A No. 2002-103735, if jammed recording paper is disposed in this paper ejection path so as to straddle between two of the image-forming sections, then if one of these image-forming sections is pulled out to the side relative to the other image-forming section in order to remove the jammed recording paper, the recording paper will be torn and removal of the torn-off piece of paper that is left in the other image-forming section will be difficult. In the worst cases, interiors of the image-forming sections and printing sections and the like may be damaged by tensile forces acting through the recording paper onto the two image-forming sections.

A printing apparatus is demanded which supplies recording mediums to a plurality of printing sections, which are arranged in a vertical direction, and parallel-processes image recording on the plurality of recording mediums by operating in a parallel manner, at which printing apparatus recording medium jam processing and maintenance operations can be carried out with ease. A printing apparatus is demanded at which, in a case in which a recording medium that has become jammed is disposed to straddle between a supply path and a printing section or between a printing section and an ejection path, or a case in which a recording medium that has become jammed is disposed to straddle between a plurality of printing units which are individually equipped with a plurality of printing sections, the device will not be damaged by processing of such jams.

SUMMARY OF THE INVENTION

In a printing apparatus of a first aspect of the present invention, a plurality of printing sections, which record images on sheet-form recording mediums, at least one storage section, which stores recording mediums to be supplied to the plurality of printing sections, and at least one ejection section, at which the recording mediums on which images have been recorded by the plurality of printing sections are ejected, are arranged in a vertical direction. The recording mediums are supplied from the at least one storage section to the plurality of printing sections, image-recording on a plurality of the recording mediums is processed in parallel by operating in a parallel manner, and the plurality of recording mediums on which images have been recorded are ejected to the at least one ejection section. This printing apparatus is provided with a supply path which extends in a vertical direction for guiding recording mediums that have been fed out from the storage section toward the printing sections. The printing apparatus further includes a supply section which feeds out the recording mediums stored in the storage section to the supply path. The printing apparatus further includes an ejection path which extends in a vertical direction for guiding the recording mediums on which images have been recorded by the printing sections toward the ejection section. This printing apparatus further includes an ejection portion which ejects recording mediums that have been fed out to the ejection path to the ejection section. The printing apparatus further includes a plurality of transport paths which are provided in correspondence with the plurality of printing sections and extend in a horizontal direction with one ends connecting with the supply path and other ends connecting with the ejection path, for guiding recording mediums that have been fed in from the supply path to the printing sections and feeding out the recording mediums on which images have been recorded by the printing sections to the ejection path. The printing apparatus further includes a plurality of sliding portions which, at each of the plurality of transport paths, render at least a portion of the transport path slidable, together with the printing section, in a direction substantially intersecting the direction in which the transport path extends, and which move the at least a portion of the transport path between a through-path formation position, at which is capable of guidance of the recording medium by the transport path, and a through-path opening position, at which is capable of extraction of a recording medium that is disposed at the transport path.

Because the printing apparatus of the first aspect of the present invention is structured as a printing apparatus in which the plurality of printing sections which record images at the sheet-form recording mediums, the at least one storage section which stores the recording mediums to be supplied to the plurality of printing sections, and the at least one ejection section which ejects the recording mediums on which images have been recorded by the plurality of printing sections are arranged in the vertical direction, a space for disposition of the printing apparatus can be made smaller than that of, for example, a structure in which a storage section and an ejection section are disposed to a side relative to printing sections, or the like.

For a printing operation of each printing section of this printing apparatus, a recording medium stored in the storage section is fed out to the supply path by the supply section and the recording medium is guided toward the printing section along the supply path, which extends in the vertical direction away from the storage section toward the printing section (the one end of the transport path). The recording medium is further fed in to the transport path, which extends in the horizontal direction with the one end communicating with the supply path, and is guided along the transport path to the printing section. Then, an image is recorded by the printing section on the recording medium that has been fed to the printing section, and this image-recorded recording medium is guided further along the transport path toward the ejection path with which the other end of the transport path communicates and is fed out to the ejection path. The image-recorded recording medium that is fed out to the ejection path is guided toward the ejection section along the ejection path, which extends in the vertical direction away from the printing section (the other end of the transport path) toward the ejection section, and is discharged to the ejection section by the ejection portion.

In such a printing operation, if the recording paper becomes jammed during printing or during feeding in the transport path, processing of this jam is performed by sliding the at least a portion of the transport path. Here, the at least a portion of the transport path is rendered slideable, together with the printing section, in the direction intersecting the direction in which the transport path extends by the sliding portion. With this sliding, the at least a portion of the transport path can be moved between the through-path formation position, which enables guidance of the recording medium by the transport path, and the through-path opening position, which enables extraction of the recording medium that is in the transport path. Consequently, when the at least a portion of the transport path is slid to move from the through-path formation position to the through-path opening position, the printing section and the at least a portion of the transport path are pulled out together with the recording medium jammed at the printing section or transport path. Therefore, a user or the like can perform this jam processing with ease. Further, because the printing section is pulled out together with the at least a portion of the transport path, maintenance operations such as supplying ink to the printing section, cleaning or replacing conveyance rollers provided in the vicinity of the printing section, and the like can be performed with ease.

BRIEF DESCRIPTION OF THE DRAWINGS

Embodiments of the invention will be described in detail based on the following figures.

DETAILED DESCRIPTION OF THE INVENTION

Herebelow, printing units and printing apparatus relating to embodiments of the present invention will be described with reference to the drawings.

First Embodiment

Figure 1:
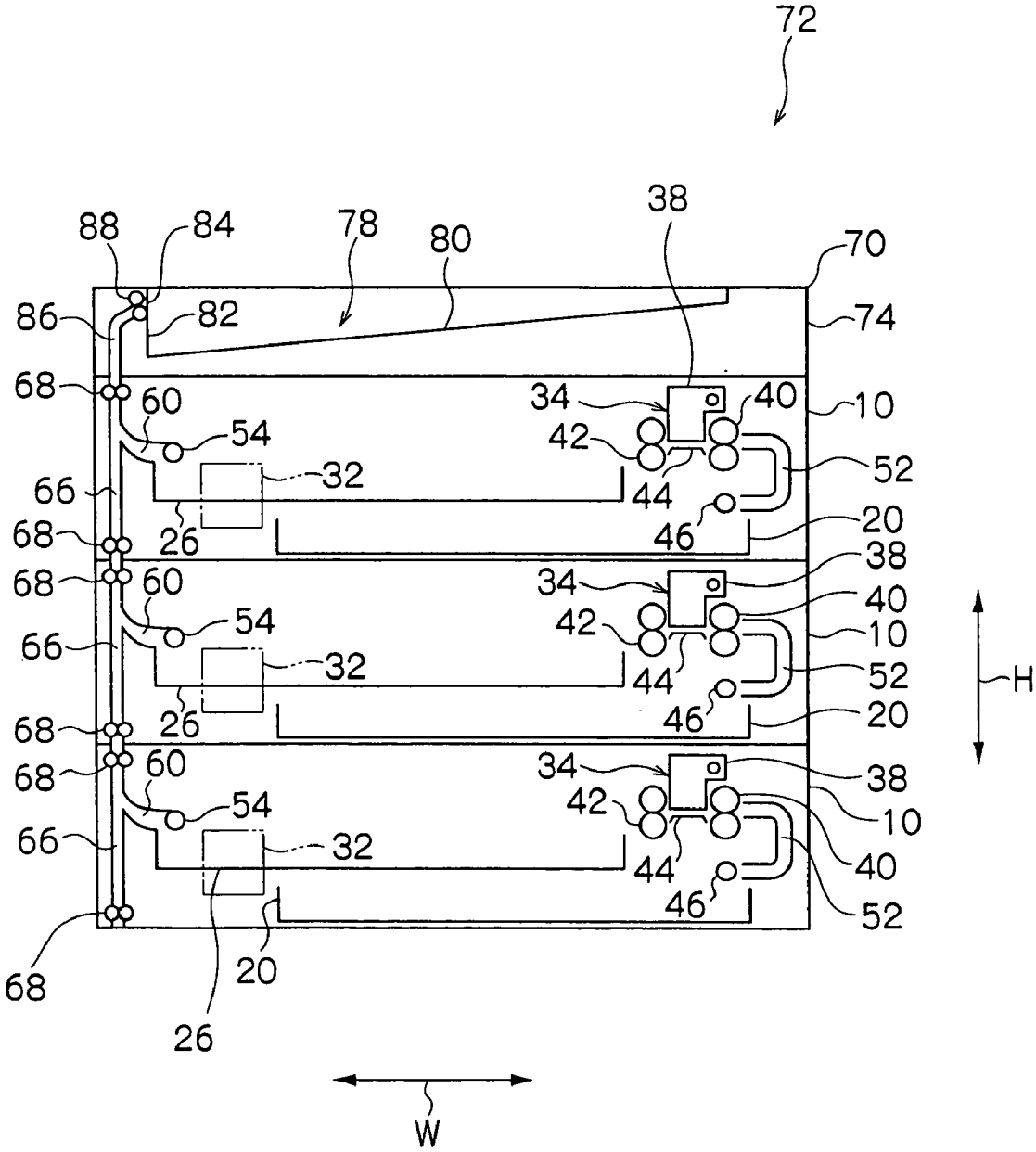
FIG. 1 is a side view showing structure of a printing apparatus relating to a first embodiment of the present invention.
Figure 2:
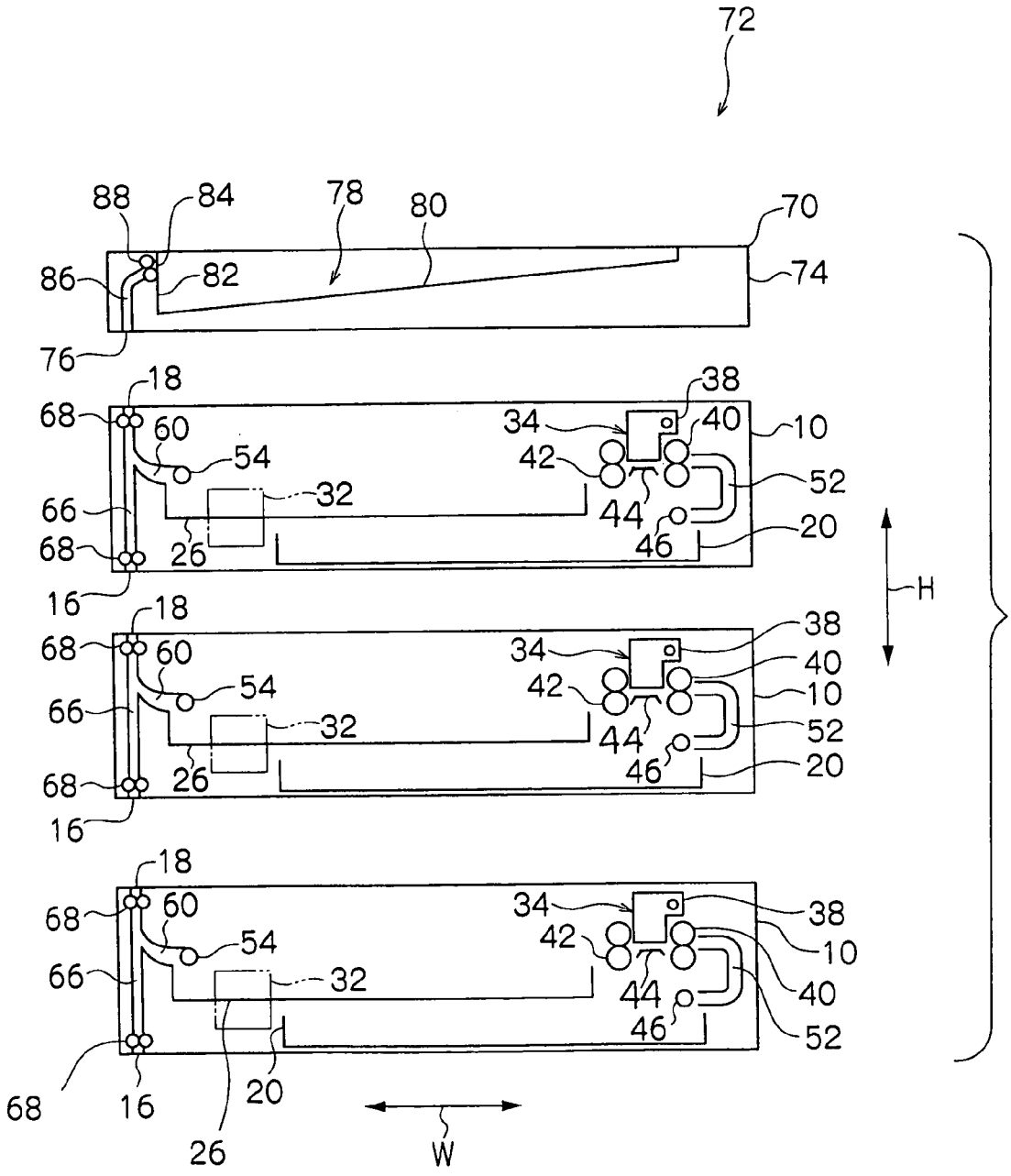
FIG. 2 is a side view showing a state in which the printing apparatus shown in FIG. 1 is broken up into unit pieces.
Figure 3:
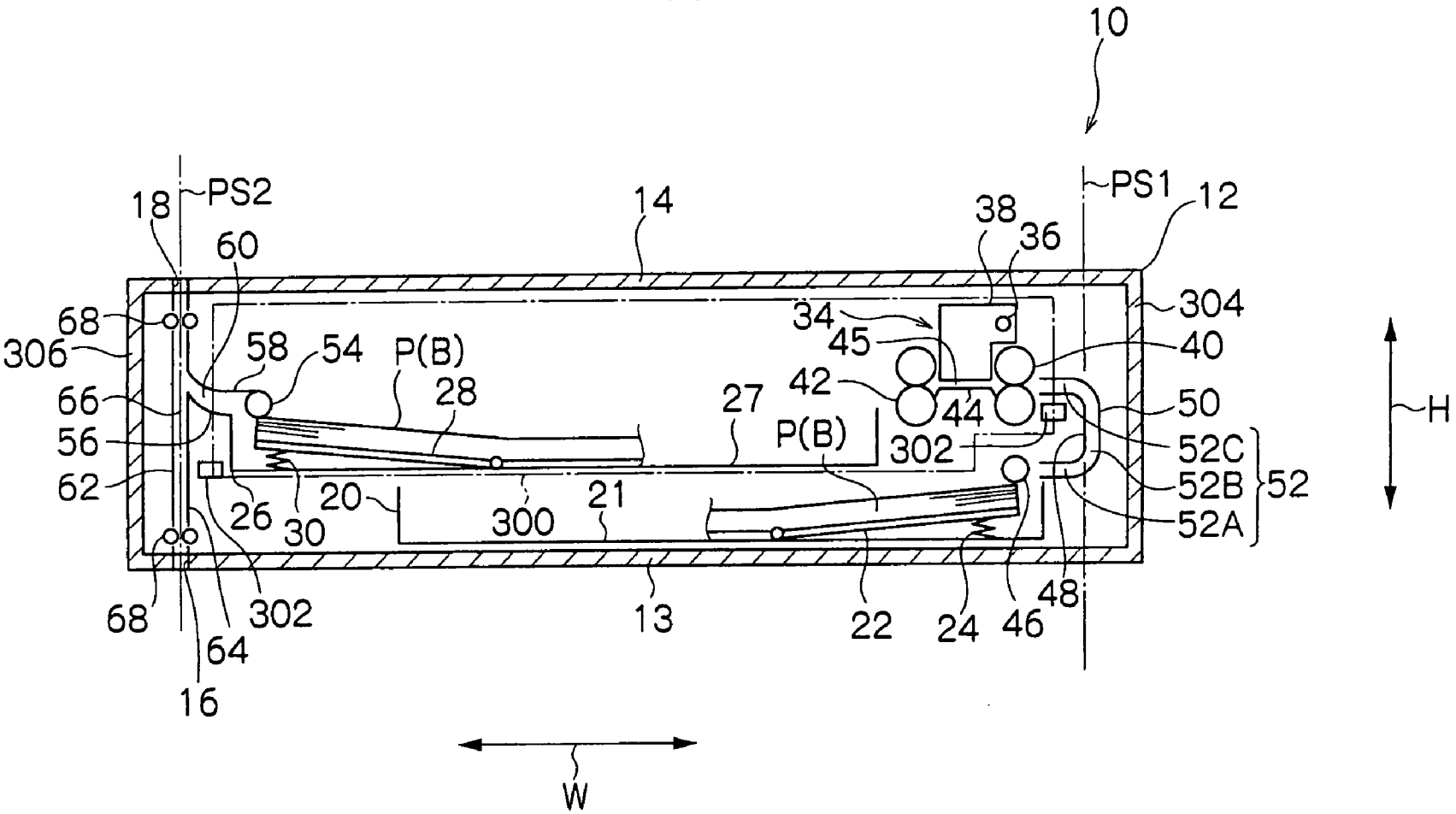
FIG. 3 is a side sectional view showing structure of a printing unit of the printing apparatus relating to the first embodiment of the present invention.
Figure 4:
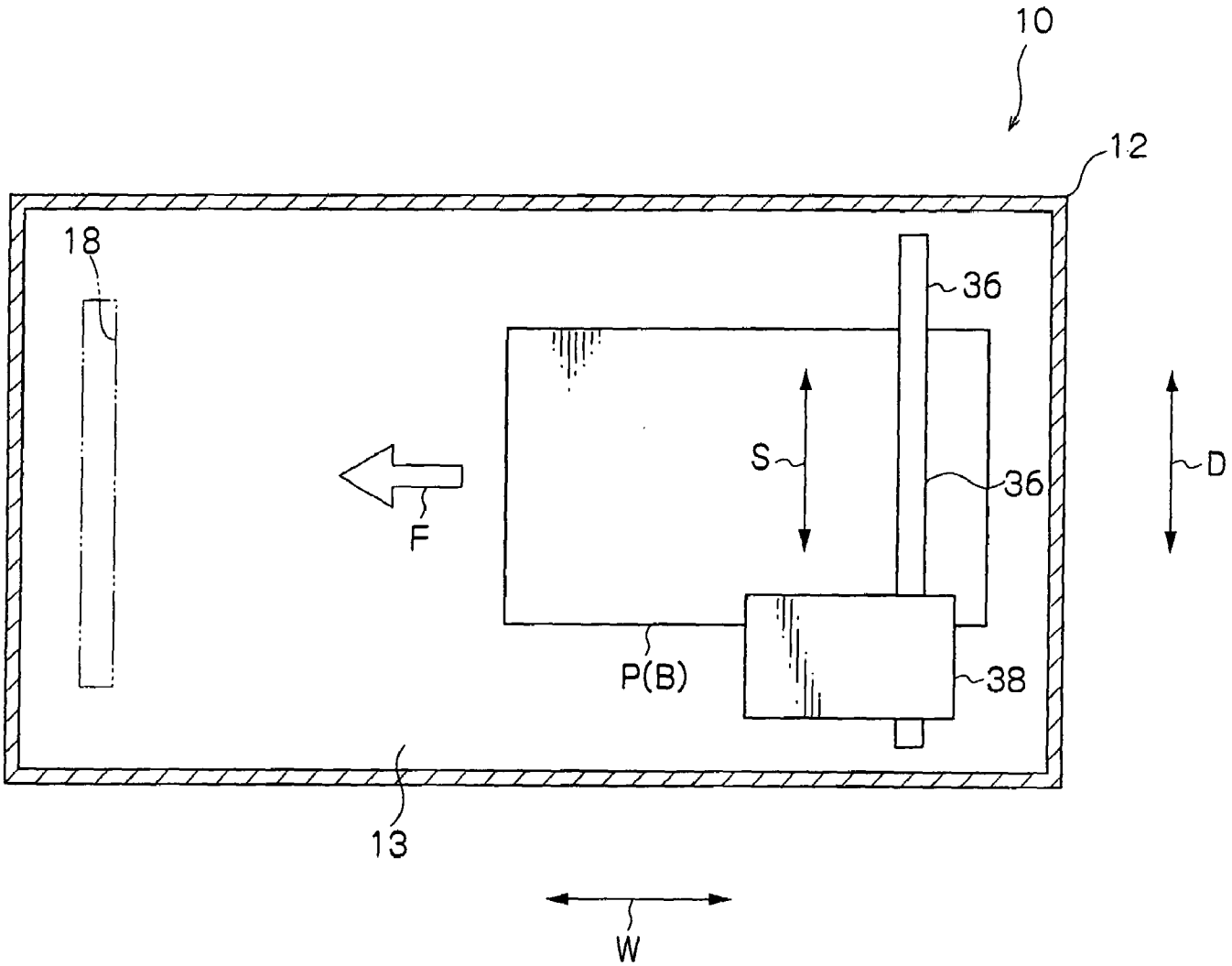
FIG. 4 is a plan view showing structure of the printing unit shown in FIG. 3.

FIGS. 1 and 2 show a printing apparatus relating to a first embodiment of the present invention. FIGS. 3 and 4 show a printing unit used in the printing apparatus relating to the present embodiment.

As shown in FIG. 3, a printing unit 10 is provided with a casing 12 which serves as an outer shell portion. This casing 12 is formed in a cuboid form which is flat along a height direction of the device (the direction of arrow H). In the casing 12, a slit-form paper supply aperture 16 is formed through a bottom plate portion 13 of the casing 12 at one end side in a breadth direction (the direction of arrow H) of the bottom plate portion 13 (at the left side in FIG. 3; hereafter, for the sake of convenience, a left side of the printing unit 10 and a paper ejection unit 70 is referred to as a rear end side, and a right side thereof is referred to as a front end side). A slit-form paper ejection aperture 18 is formed through a top plate portion 14 of the casing 12 so as to oppose the paper supply aperture 16. A paper supply hopper 20 is disposed in the casing 12. The paper supply hopper 20 is a box-form tray on the bottom plate portion 13 which is open at an upper face side thereof. A single sheet of recording paper P or a recording paper bundle in which a plurality of sheets of the recording paper P are stacked (below, this is specifically referred to as paper bundle B where necessary to distinguish it from the recording paper P) can be stored in the paper supply hopper 20.

As shown in FIG. 3, in the paper supply hopper 20, a flat plate-form stacking plate 22 is disposed on a bottom plate portion 21, and the recording paper P stored in the paper supply hopper 20 is placed on this stacking plate 22. One end portion in the breadth direction of the stacking plate 22 is joined to the bottom plate portion 21 to be capable of swinging, and a swinging end side of the stacking plate 22 is urged upward by an urging member 24, such as a coil spring or the like. Consequently, a leading end side of the recording paper P stored in the paper supply hopper 20 experiences a pushing force from the stacking plate 22 and is urged upward.

The paper supply hopper 20 is supported by the casing 12 to be slideable along a depth direction (the direction of arrow D shown in FIG. 4), between a mounted position and a supply position. When the paper supply hopper 20 slides from the mounted position inside the casing 12 to the supply position, the opening portion at the upper face side of the paper supply hopper 20 is put into an opened state, and recording paper P can be supplied or removed through this opening portion. A restraining mechanism (not shown) for restraining the stacking plate 22, in opposition to the urging member 24, is provided at the paper supply hopper 20. In conjunction with the sliding of the paper supply hopper 20 from the mounted position to the supply position, this restraining mechanism swings the stacking plate 22 to a lower limit position which is close to the bottom plate portion 13 and restrains the stacking plate 22. Further, in conjunction with sliding of the paper supply hopper 20 from the supply position to the mounted position, the restraining mechanism releases the stacking plate 22.

As shown in FIG. 3, a paper ejection buffer 26 in the form of a box whose upper face end is open is provided at an upper side of the paper supply hopper 20. The recording paper P can be stored in this paper ejection buffer 26. In the paper ejection buffer 26, similarly to the paper supply hopper 20, a flat plate-form stacking plate 28 is swingably provided on a bottom plate portion 27. The recording paper P accommodated in the paper ejection buffer 26 is placed on this stacking plate 28. An end portion of the stacking plate 28 at one side in the breadth direction (the right side in FIG. 3) is joined to the bottom plate portion 27 to be capable of swinging, and a swinging end side thereof is urged upward by an urging member 30, such as a coil spring or the like. Consequently, a leading end side of the recording paper P stored in the paper ejection buffer 26 experiences a pushing force from the stacking plate 28 and is urged upward. Here, the orientation of the leading end of the recording paper P in the paper ejection buffer 26 is opposite to that in the paper supply hopper 20.

An actuator (not shown) is provided at the paper ejection buffer 26, at a lower face side of the bottom plate portion 27, for opposing the urging member 30, moving the stacking plate 28 in a swinging direction to a lower limit position thereof and restraining the stacking plate 28. When an image-recorded recording paper P is to be received into the paper ejection buffer 26, this actuator swings the stacking plate 28 to the lower limit position near the bottom plate portion 27 and restrains the stacking plate 28, and releases the stacking plate 28 after the recording paper P has been completely received into the paper ejection buffer 26.

As shown in FIGS. 3 and 4, a printing section 34 is disposed at a location adjacent to the paper ejection buffer 26 along the breadth direction, which is upward of the paper supply hopper 20. A guide rod 36 and an inkjet head 38 are provided at the printing section 34. The guide rod 36 extends in a main scanning direction which is parallel to the depth direction (the direction of arrow S shown in FIG. 4), and the inkjet head 38 is supported by the guide rod 36 to be movable in the main scanning direction. A head-driving mechanism (not shown) is also provided at the printing section 34. The head-driving mechanism reciprocatingly moves the inkjet head 38 in the predetermined main scanning direction at times of image recording on the recording paper P.

As shown in FIG. 3, a pair of nipping rollers 40 and a pair of rollers 42 are provided at the printing section 34 so as to sandwich the inkjet head 38 along a sub-scanning direction, which intersects the main scanning direction. A guide plate 44 is also provided at the printing section 34, between these roller pairs 40 and 42. The guide plate 44 forms a slit-like gap between the guide plate 44 and a lower face portion of the inkjet head 38. The nipping roller pair 40 and roller pair 42 convey the recording paper P in the sub-scanning direction (the direction of arrow F shown in FIG. 4) at a predetermined sub-scanning speed.

At the inkjet head 38, a plurality of nozzles (not shown) are formed in a lower face portion of the inkjet head 38. The nozzles are arranged with a pitch along the main scanning direction that corresponds to a pixel density of the images that are to be recorded. While the inkjet head 38 is being moved in the main scanning direction by the head-driving mechanism, ink is jetted/not jetted from each nozzle in accordance with digital image data. Thus, an image corresponding to the image data is formed on the recording paper P that is being conveyed in the sub-scanning direction by the nipping roller pair 40 and roller pair 42.

As shown in FIG. 3, in the printing unit 10, a cylindrical separation and supply roller 46 is disposed above the paper supply hopper 20. This separation and supply roller 46 presses against the leading end side of an upper face of the recording paper P (paper bundle B), which is stored in the paper supply hopper 20 and urged upward by the stacking plate 22. A pair of printing guide plates 48 and 50 is also provided in the printing unit 10. Between the separation and supply roller 46 and the nipping roller pair 40, the printing guide plates 48 and 50 form a fixed gap and oppose one another. The printing guide plates 48 and 50 each curve in a 'U' shape. A printing guide path 52 for guiding a single sheet of recording paper P to the nipping roller pair 40 is formed between this pair of printing guide plates 48 and 50.

In the printing unit 10, when recording paper P is to be supplied to the inkjet head 38, the separation and supply roller 46 presses against the recording paper P in the paper supply hopper 20 and rotates by a predetermined amount. As a result, one sheet of the recording paper P is separated from inside the paper supply hopper 20 and this single sheet of recording paper P is conveyed along the printing guide path 52 to the nipping roller pair 40 by conveyance force from the separation and supply roller 46. Here, a path length of the printing guide path 52 is comparatively long, so if the recording paper P is incapable of conveying reliably as far as the nipping roller pair 40 by the conveyance force of the separation and supply roller 46 alone, a conveyance roller pair may be provided partway along the printing guide path 52, such that a recording paper P that has been conveyed partway along the printing guide path 52 can be conveyed as far as the nipping roller pair 40 by this conveyance roller pair.

As shown in FIG. 3, in the printing unit 10, a cylindrical separation and ejection roller 54 is provided above the paper ejection buffer 26. This separation and ejection roller 54 presses against the leading end side of an upper face of the recording paper P (paper bundle B) which is stored in the paper ejection buffer 26 and urged upward by the stacking plate 28. A pair of branch guide plates 56 and 58, which extend to a rear end side from the separation and supply roller 46, are also provided in the printing unit 10. The branch guide plates 56 and 58 are supported so as to form a fixed gap and oppose one another. A branch guide path 60 for guiding a single sheet of recording paper P to a paper ejection guide path 66, which is described later, is formed between this pair of branch guide plates 56 and 58.

A pair of paper ejection guide plates 62 and 64, which extend in a vertical direction, are provided in the printing unit 10 at a rear end portion thereof. The pair of paper ejection guide plates 62 and 64 are supported so as to form a fixed gap and oppose one another. The paper ejection guide path 66 for guiding the single recording paper P to the paper ejection unit 70, which is described later, is formed between this pair of paper ejection guide plates 62 and 64. The paper ejection guide path 66 connects the paper supply aperture 16 and paper ejection aperture 18 formed in the casing 12. Conveyance roller pairs 68, for conveying the recording paper P along the paper ejection guide path 66 toward the paper ejection unit 70, are also provided in the printing unit 10. These conveyance roller pairs 68 are respectively disposed at least at an upper end portion and a lower end portion of the paper ejection guide path 66. The conveyance roller pairs 68 may be provided as appropriate between the upper end portion and the lower end portion of the paper ejection guide path 66 in accordance with the path length of the paper ejection guide path 66, the length of the recording paper P and the like.

As shown in FIG. 1, a printing apparatus 72 relating to the present embodiment is structured by stacking one or more (three in FIG. 1) of the printing unit 10 and the paper ejection unit 70 in a height direction. Herein, the paper ejection unit 70 is used for receiving and temporarily storing the recording paper P on which images have been recorded by the printing units 10, and is disposed at a topmost level of the printing apparatus 72.

The paper ejection unit 70 is provided with a casing 74 which serves as an outer shell portion. Sizes of the casing 74 in the breadth direction and the depth direction are substantially the same as for the casing 12 of the printing unit 10. A slit-form insertion aperture 76 (see FIG. 2) is opened at a rear end side of a lower face portion of the casing 74. This insertion aperture 76 connects with the paper ejection aperture 18 of the printing unit 10 that is disposed adjacent to the paper ejection unit 70 at a lower level side thereof. A paper ejection tray portion 78, on which a number of sheets of the recording paper P can be stacked, is formed at an upper face portion of the casing 74. A stacking face 80 and a positioning face 82 are formed at the paper ejection tray portion 78. The stacking face 80 is inclined upward from one end portion, at the insertion aperture 76 side thereof, toward the other end. The positioning face 82 rises substantially vertically from the one end portion of the stacking face 80. A slit-form paper ejection aperture 84 is opened at an upper end side of this positioning face 82. A receiving guide path 86, which connects the paper ejection aperture 84 with the insertion aperture 76, is formed within the casing 74. A conveyance roller pair 88 is also provided in the paper ejection unit 70, at the paper ejection aperture 84 side end portion of the receiving guide path 86.

As shown in FIG. 1, in a case in which the printing unit 10 that is disposed at the lower level side of the paper ejection unit 70 has another printing unit 10 disposed at a lower level side thereof, the paper supply aperture 16 thereof connects with the paper ejection aperture 18 of the printing unit 10 at the lower level side. If another printing unit 10 is disposed at an upper level side of the printing unit 10, the paper ejection aperture 18 thereof connects with the paper supply aperture 16 of the printing unit 10 at the upper level side. Thus, in a case in which a plurality of the printing units 10 are disposed at the lower level side of the paper ejection unit 70, the paper ejection guide paths 66 of the printing units 10 are connected with one another. These paper ejection guide paths 66 structure a single paper ejection course which extends in a height direction so as to pass through each of the printing units 10, an upper end portion of which connects with the receiving guide path 86 of the paper ejection unit 70.

At the casing 12 of the printing unit 10, guide protrusions (not shown) which protrude upward are formed at the top plate portion 14, and recess-form guide-receiving portions (not shown), which correspond to the guide protrusions, are formed at the bottom plate portion 13. Further, recess-form guide-receiving portions corresponding to the guide protrusions are formed at a lower face portion of the paper ejection unit 70. At least two of each of these guide protrusions and guide-receiving portions are provided at each of the printing units 10, and at least two of the guide-receiving portions are provided at the paper ejection unit 70. In the state in which the printing apparatus 72 is structured by stacking the printing units 10 and the paper ejection unit 70, the guide protrusions provided at any printing unit 10 are inserted into the guide-receiving portions of the printing unit 10 or paper ejection unit 70 at the upper level side of that printing unit 10, and the guide-receiving portions accommodate the guide protrusions provided at the printing unit 10 at the lower level side of that printing unit 10. Thus, the printing units 10 and the paper ejection unit 70 are positioned so as to align with one another along the breadth direction and the depth direction, and are integrated by movement between the units 10 and 70 being restricted.

The plurality of printing units 10 that structure the printing apparatus 72 are each provided with a control section 32. The control sections 32 of the printing units 10 are electrically connected together. In order to electrically connect between the control sections 32 of the printing units 10, for example, cables and sockets may be provided at the respective printing units 10, and a connector provided at a distal end of each cable may be inserted into the socket of another of the printing units 10 for electrical connection. Alternatively, one or more of each of the sets of guide protrusions and guide-receiving portions may be structured as a connector and a socket, respectively, which fit to one another, and these may be electrically connected by the guide protrusions that serve as connectors being inserted into the guide-receiving portions that serve as sockets when the printing units 10 are stacked.

As described above, the printing apparatus 72 is structured by stacking the printing units 10 and the paper ejection unit 70. Therefore, of the printing units 10 and paper ejection unit 70 that structure the printing apparatus 72, a printing unit 10 at a lower level side can be separated as a unit simply by lifting up the units 10 and 70 at the upper level side thereof, as shown in FIG. 2. Accordingly, if the printing apparatus 72 is put into a state in which one of the printing units 10 is separated from another of the printing units 10 or the paper ejection unit 70 is separated from the printing unit 10 at the lower level side thereof, one or a number of the printing units 10 can be inserted between the one printing unit 10 and the other printing unit 10 or between the printing unit 10 and the paper ejection unit 70, or to take out one or a number of the printing units 10 from between those printing units 10 or from between the printing unit 10 and the paper ejection unit 70. Thus, at the printing apparatus 72, the number of the printing units 10 that structure the device can be easily increased/reduced, and the printing capabilities of the device can be adjusted as a whole, including printing speeds, by increasing/reducing the number of printing units 10.

Next, structures for carrying out jam processing of recording paper P and maintenance of the printing apparatus 72 provided with the printing units 10 and the paper ejection unit 70 of the present embodiment will be described using FIGS. 3, 5 and 6.

As described above, the following are provided in the printing unit 10: the printing guide path 52 for guiding the recording paper P conveyed from the paper supply hopper 20 to the printing section 34 disposed upward of the leading end side of the paper supply hopper 20; the paper ejection buffer 26 disposed at the rear side of the printing section 34 and arranged in a substantially horizontal orientation, which temporarily retains the recording paper P on which images have been recorded by the printing section 34; the branch guide path 60 extending in the vertical direction for guiding recording paper P that has been conveyed from the paper ejection buffer 26 to the paper ejection guide path 66 provided at the rear end portion in the printing unit 10; and the paper ejection guide path 66 for guiding the recording paper P on which images have been recorded from inside the printing unit 10 to the paper ejection tray portion 78 side of the paper ejection unit 70 thereabove. In the printing unit 10 of the present embodiment, these respective guide paths and the paper ejection buffer 26 form: at a front end side in the printing unit 10, a supply path which is provided extending in a vertical direction for guiding recording paper P that has been fed out from the paper supply hopper 20 toward the printing section 34; at a rear end portion in the printing unit 10, an ejection path which is provided extending in a vertical direction for guiding the recording paper P on which images have been recorded by the printing section 34 toward the paper ejection tray portion 78 of the paper ejection unit 70; and between the supply path and the ejection path, a transport path which is provided extending in a horizontal direction with one end (a front end) thereof connecting with the supply path and the other end (a rear end) connecting with the ejection path, for guiding the recording paper P that has been fed in from the supply path to the printing section 34 and feeding out the recording paper P on which images have been recorded by the printing section 34 to the ejection path.

As shown in FIG. 3, the above-mentioned supply path is structured by a lower guide path portion 52A and an intermediate guide path portion 52B. The lower guide path portion 52A is disposed at an upstream side of the printing guide path 52 in a direction of conveyance of the recording paper P and extends substantially horizontally forward (rightward) from a leading end upper portion of the paper supply hopper 20. The intermediate guide path portion 52B is disposed at an intermediate portion of the printing guide path 52 in the direction of conveyance of the recording paper P, and is inflected to extend substantially vertically upward from a front end portion of the lower guide path portion 52A. The ejection path is structured by the paper ejection guide path 66, which is disposed at an end portion in the printing unit 10 at a side thereof opposite to the side at which the supply path is disposed (i.e., at a rear end portion), and extends substantially vertically. The transport path is structured by an upper guide path portion 52C, a sub-scanning guide path 45, the paper ejection buffer 26 and the branch guide path 60. The upper guide path portion 52C is disposed at a downstream side of the printing guide path 52 in the direction of conveyance of the recording paper P and is inflected to extend substantially horizontally rearward (leftward) from an upper end portion of the intermediate guide path portion 52B. The sub-scanning guide path 45 extends substantially horizontally above the guide plate 44 between the nipping roller pair 40 and the roller pair 42.

Now, in the printing unit 10 of the present embodiment, a portion of the transport path described above is set to be slideable in the depth direction (the direction of arrow D shown in FIG. 6), which is a direction substantially intersecting the direction in which the transport path extends (the horizontal direction), relative to the casing 12 of the printing unit 10 between a mounted position (a closed position) and an open position. This portion of the transport path includes a rear portion (left portion) of the upper guide path portion 52C of the printing guide path 52, the sub-scanning guide path 45, the paper ejection buffer 26 and a front portion (right portion) of the branch guide path 60. This transport path portion is assembled to an upper face side of a sliding panel 300, together with the printing section 34 (the guide rod 36, the inkjet head 38, the head-driving mechanism, the nipping roller pair 40 and the roller pair 42), the separation and ejection roller 54 and the like, which are also assembled to the upper face side of the sliding panel 300, and these members are formed into a unit.

A front end portion and a rear end portion of the sliding panel 300 are attached to the casing 12 via a pair of guide rails 302. The sliding panel 300 is rendered slideable relative to the casing 12 along the direction of arrow D of FIG. 6 by this pair of guide rails 302. Stoppers are incorporated in the pair of guide rails 302 for restricting a range of drawing out of the sliding panel 300 and preventing the sliding panel 300 from falling down when the sliding panel 300 is drawn out to the open position, at which an upper face side thereof is open, as shown in FIG. 6. An unillustrated locking mechanism is also provided at the sliding panel 300. The locking mechanism locks the sliding panel 300 to the casing 12 when the sliding panel 300 has been pushed into the casing 12 from the open position shown in FIG. 6 and moved to the mounted position. This locking mechanism is set to be unlockable by a manual operation by a user, service engineer or the like.

Accordingly, when a user or the like-pushes the sliding panel 300 into the casing 12 from the open position and moves the sliding panel 300 to the mounted position, the transport path portion (the rear portion of the upper guide path portion 52C of the printing guide path 52, the sub-scanning guide path 45, the paper ejection buffer 26 and the front portion of the branch guide path 60) is accommodated in the casing 12, together with the printing section 34, the separation and ejection roller 54 and the like, and is disposed at a through-path formation position at which can guide the recording paper P by the transport path, and the sliding panel 300 is locked to the casing 12 by the locking mechanism. Further, when a user or the like unlocks the locking mechanism of the sliding panel 300 by the manual operation, draws out the sliding panel 300 from the mounted position and moves the sliding panel 300 to the open position, the transport path portion is exposed to the exterior, together with the printing section 34, the separation and ejection roller 54 and the like, and the paper ejection buffer 26 is put into a state in which an opening portion of the upper face side thereof is opened. Thus, extraction of the image-recorded recording paper P stored in the paper ejection buffer 26 can be done through this opening portion, and recording paper P that has jammed in the transport path can be removed. Moreover, because the inkjet head 38, the nipping roller pair 40, the roller pair 42 and the separation and ejection roller 54 are also exposed to the outside, maintenance such as supplying ink to the inkjet head 38, cleaning, replacing each roller, or other jobs can be performed.

Next, a structure for carrying out jam processing of the recording paper P and maintenance at the supply path of the printing unit 10 will be described.

In the printing unit 10 of the present embodiment, of the aforementioned supply path structured by the lower guide path portion 52A and the intermediate guide path portion 52B of the printing guide path 52, a portion of this supply path is made cleavable in the vertical direction. Herein, the aforementioned intermediate guide path portion 52B of the supply path is set to be cleavable as shown in FIG. 5.

Figure 5:
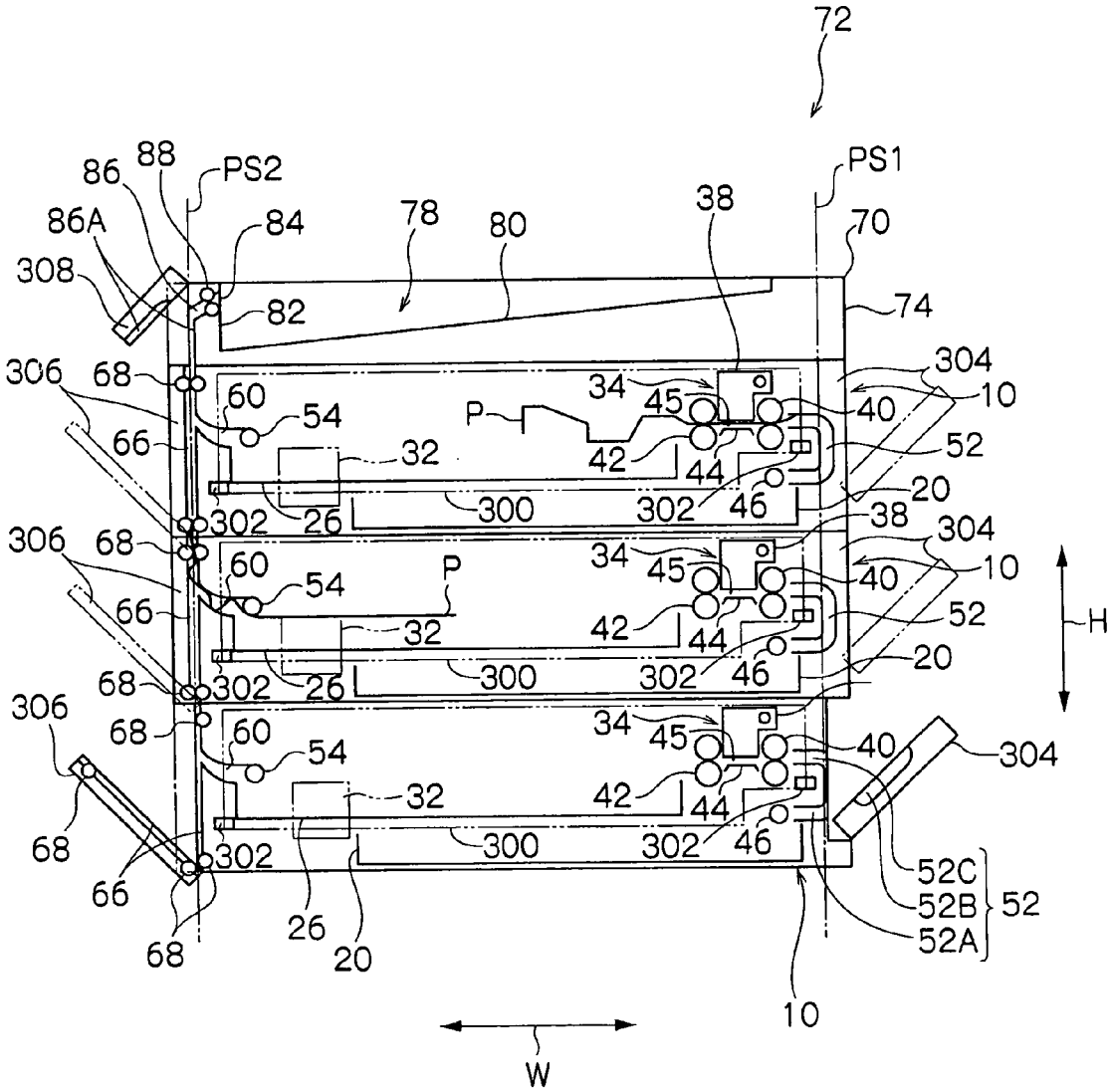
FIG. 5 is a side view showing structures for performing jam processing and maintenance of a supply path and an ejection path of the printing apparatus shown in FIG. 1.
Figure 6:
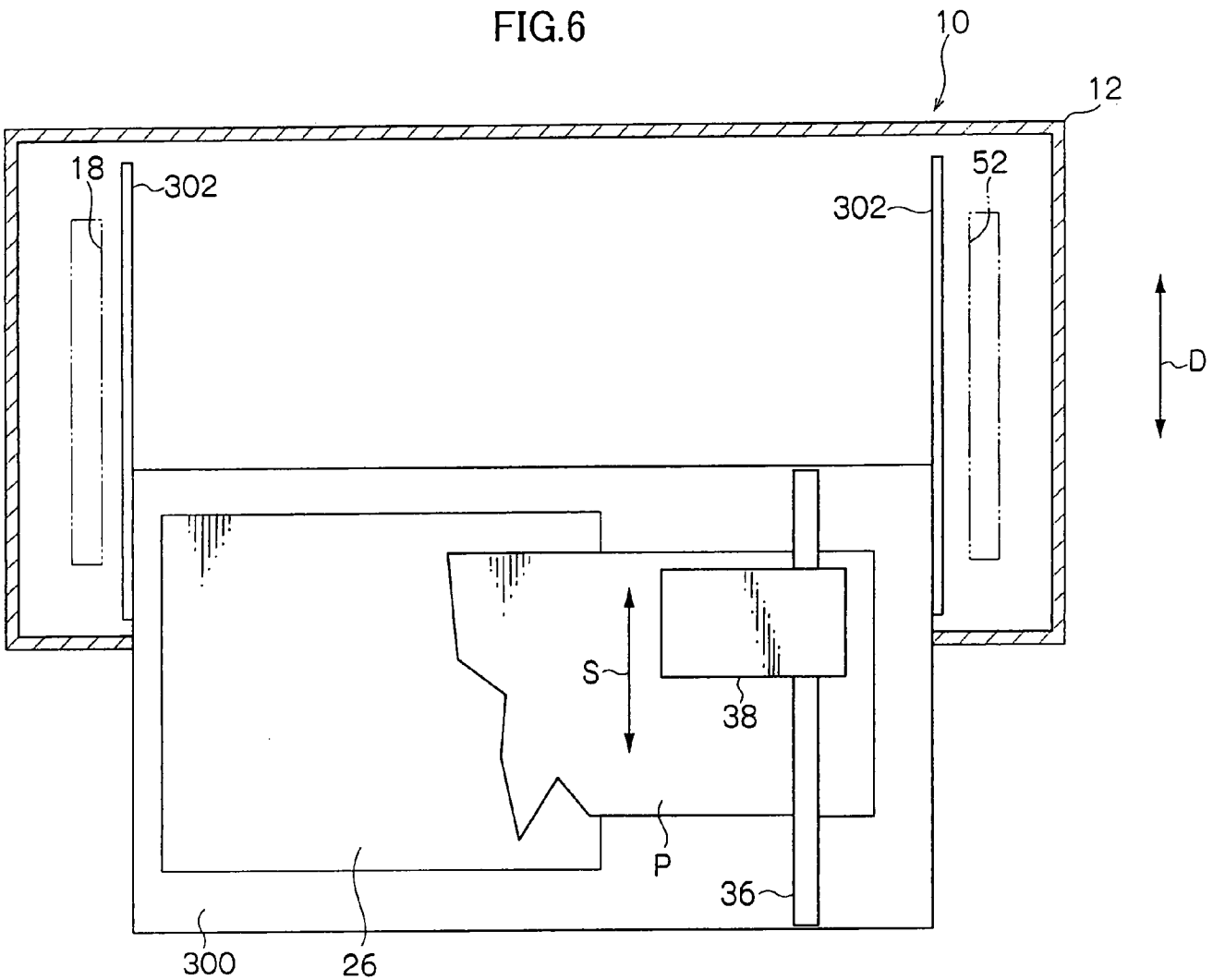
FIG. 6 is a plan view showing a structure for performing jam processing and maintenance of a transport path of the printing unit shown in FIG. 3.

As shown in FIGS. 3 and 5, an opening/closing panel 304 is provided at the printing unit 10, at a front face of the casing 12. The opening/closing panel 304 is rotatably attached to the casing 12 via an unillustrated hinge, which is provided at a lower end portion of the opening/closing panel 304. The front face of the casing 12 and an inner face of the opening/closing panel 304 can be opened and closed by rotation of this opening/closing panel 304. The intermediate guide path portion 52B that structures the supply path is formed between this opening/closing panel 304 and the casing 12. More specifically, a front side guide path interior wall face of the intermediate guide path portion 52B is formed at the inner face of the opening/closing panel 304, and a rear side guide path interior wall face of the intermediate guide path portion 52B is formed at the front face of the casing 12. When the opening/closing panel 304 is closed, the intermediate guide path portion 52B is formed between the opening/closing panel 304 and the casing 12, in a through-path formation state in which can guide the recording paper P by the supply path. A plane of cleaving of the intermediate guide path portion 52B (the broken lines PS1 in FIGS. 3 and 5) is provided to be coplanar with the rear side guide path interior wall face of the intermediate guide path portion 52B. An unillustrated locking mechanism is also provided at the opening/closing panel 304. This locking mechanism locks the opening/closing panel 304 to the casing 12 when the opening/closing panel 304 is closed. This locking mechanism is set to be unlockable by a manual operation by a user, service engineer or the like.

Thus, when a user or the like lifts the opening/closing panel 304 from an open position, rotates the opening/closing panel 304 toward the casing 12, superposes the opening/closing panel 304 with the front face of the casing 12 and closes the opening/closing panel 304, the intermediate guide path portion 52B is formed between the opening/closing panel 304 and the casing 12 in the through-path formation state, in which can guide the recording paper P by the supply path, and the opening/closing panel 304 is locked to the casing 12. Further, when a user or the like unlocks the locking mechanism of the opening/closing panel 304 by the manual operation, pulls the closed opening/closing panel 304 down and rotates the opening/closing panel 304 to the open position, the intermediate guide path portion 52B is put into an opened state in which the intermediate guide path portion 52B is cleaved along the vertical direction and the guide path interior wall faces are exposed. Hence, consequent to cleaving and opening the intermediate guide path portion 52B, recording paper P that has jammed in the supply path can be removed, and maintenance such as cleaning the supply path or the like can be performed.

Next, a structure for carrying out jam processing of the recording paper P and maintenance at the ejection path of the printing unit 10 will be described.

In the printing unit 10 of the present embodiment, of the aforementioned ejection path structured by the paper ejection guide path 66, the whole of this ejection path is made cleavable along the vertical direction, as shown in FIG. 5.

As shown in FIGS. 3 and 5, an opening/closing panel 306 is provided at the printing unit 10, at a rear face of the casing 12. The opening/closing panel 306 is rotatably attached to the casing 12 via an unillustrated hinge, which is provided at a lower end portion of the opening/closing panel 306. The rear face of the casing 12 and an inner face of the opening/closing panel 306 can be opened and closed by rotation of the opening/closing panel 306. The ejection path (the paper ejection guide path 66) is formed between this opening/closing panel 306 and the casing 12. More specifically, a rear side guide path interior wall face of the ejection path is formed at the inner face of the opening/closing panel 306, and a front side guide path interior wall face of the ejection path is formed at the rear face of the casing 12. When the opening/closing panel 306 is closed, the paper ejection guide path 66 is formed between the opening/closing panel 306 and the casing 12 in a through-path formation state, in which can guide the recording paper P. A plane of cleaving of this ejection path (the broken lines PS2 in FIGS. 3 and 5) is set to be a substantially vertical flat plane passing along the center of a guide path width in a front-rear direction of the paper ejection guide path 66. An unillustrated locking mechanism is also provided at the opening/closing panel 306. The locking mechanism locks the opening/closing panel 306 to the casing 12 when the opening/closing panel 306 is closed. This locking mechanism is set to be unlockable by a manual operation by a user, service engineer or the like.

Thus, when a user or the like lifts the opening/closing panel 306 from an open position, rotates the opening/closing panel 306 toward the casing 12, superposes the opening/closing panel 306 with the rear face of the casing 12 and closes the opening/closing panel 306, the paper ejection guide path 66 is formed between the opening/closing panel 306 and the casing 12 in the through-path formation state, in which can guide the recording paper P by the ejection path, and the opening/closing panel 306 is locked to the casing 12. Further, when a user or the like unlocks the locking mechanism of the opening/closing panel 306 by the manual operation, pulls the closed opening/closing panel 306 down and rotates the opening/closing panel 306 to the open position, the paper ejection guide path 66 is put into an opened state in which the paper ejection guide path 66 is cleaved along the vertical direction and the guide path interior wall faces are exposed. Hence, consequent to cleaving and opening the paper ejection guide path 66 (the ejection path), recording paper P that has jammed in the ejection path can be removed, and maintenance such as cleaning the ejection path, cleaning or replacing the conveyance roller pairs 68 or the like can be performed.

Next, a structure for carrying out jam processing of the recording paper P and maintenance at the receiving guide path 86 of the paper ejection unit 70 will be described.

In the paper ejection unit 70 of the present embodiment, a portion of the receiving guide path 86 is set to be cleavable along a vertical direction. Here, a lower receiving guide path portion 86A, which extends substantially vertically to structure a lower portion side of the receiving guide path 86, is made cleavable, as shown in FIG. 5.

As shown in FIG. 5, an opening/closing panel 308 is provided at the paper ejection unit 70, at a rear face of the casing 74. The opening/closing panel 308 is rotatably attached to the casing 74 via an unillustrated hinge, which is provided at an upper end portion of the opening/closing panel 308. Thus, the rear face of the casing 74 and an inner face of the opening/closing panel 308 can be opened and closed by rotation of the opening/closing panel 308. The lower receiving guide path portion 86A is formed between this opening/closing panel 308 and the casing 74. More specifically, a rear side guide path interior wall face of the lower receiving guide path portion 86A is formed at the inner face of the opening/closing panel 308, and a front side guide path interior wall face of the lower receiving guide path portion 86A is formed at the rear face of the casing 74. When the opening/closing panel 308 closes, the lower receiving guide path portion 86A is formed between the opening/closing panel 308 and the casing 74 in a through-path formation state, in which can guide the recording paper P by the receiving guide path 86. A plane of cleaving of this lower receiving guide path portion 86A is set to be a substantially vertical flat plane passing along the center of a guide path width in a front-rear direction of the lower receiving guide path portion 86A. As shown in FIG. 5, in the state in which the paper ejection unit 70 is stacked at the upper level of the printing units 10 to structure the printing apparatus 72, the plane of cleaving of the lower receiving guide path portion 86A is made coplanar with the plane of cleaving PS2 of the ejection paths (the paper ejection guide paths 66) of the printing units 10. An unillustrated locking mechanism is also provided at the opening/closing panel 308. The locking mechanism locks the opening/closing panel 308 to the casing 74 when the opening/closing panel 308 is closed. This locking mechanism is set to be unlockable by manual operation by a user, service engineer or the like.

Thus, when a user or the like rotates the opening/closing panel 308 from an open position toward the casing 12, superposes the opening/closing panel 308 with the rear face of the casing 12 and closes the opening/closing panel 308, the lower receiving guide path portion 86A is formed between the opening/closing panel 308 and the casing 74 in the through-path formation state, in which can guide the recording paper P by the receiving guide path 86, and the opening/closing panel 308 is locked to the casing 74. Further, when a user or the like unlocks the locking mechanism of the opening/closing panel 308 by the manual operation, pulls the closed opening/closing panel 308 up and rotates the opening/closing panel 308 to the open position, the lower receiving guide path portion 86A is put into an opened state in which the lower receiving guide path portion 86A is cleaved along the vertical direction and the guide path interior wall faces are exposed. Hence, at the receiving guide path 86, consequent to cleaving and opening the lower receiving guide path portion 86A, recording paper P that has jammed in the receiving guide path 86 can be removed, and maintenance such as cleaning the receiving guide path 86 or the like can be done.

Next, operations by the printing unit 10 and printing apparatus 72 relating to the present embodiment, which are structured as described above, will be described.

At the printing apparatus 72, the control section 32 of the printing unit 10 is connected to an external data processing device (not shown), such as a personal computer, a server or the like. When a print command and image data are inputted from this data processing device, the printing unit 10 commences an image-recording operation on the recording paper P.

In a case in which a plurality of the printing unit 10 is provided at the printing apparatus 72, the control sections 32 of the printing units 10 may be connected to the data processing device in parallel, or may be structured with any one of the plurality of printing units 10 serving as a main printing unit 10, with the control section 32 of this main printing unit 10 alone being connected to the data processing device and the respective kinds of data being outputted to the control sections 32 of the other printing units 10 through the control section 32 of this main printing unit. Furthermore, the main printing unit 10 may have different capabilities and functions from the other printing units 10, such as data processing rates, memory capacity and the like.

Further, in the printing apparatus 72 of the present embodiment, when a print command and image data are inputted, the printing units 10 are operated in a cyclical manner in a predetermined order, such that the number of recordings on the recording paper P by the respective printing units 10 are equalized as much as possible. Further, in the printing apparatus 72, in a case in which print commands and image data for a plurality of numbers of sheets are inputted at the same time, as many as possible of the printing units 10 are operated simultaneously, and respective images are formed on the recording paper P by the plurality of printing units 10 that are operating simultaneously. At such a time, the images being recorded on the recording paper P by each printing unit 10 may be different for each printing unit 10, and may be the same.

Firstly, an operation of recording an image on the recording paper P at each printing unit 10 will be described.

In the printing apparatus 72, when a printing command and image data are inputted from the data processing device, at least one of the printing units 10 operates and begins image formation on the recording paper P. At this time, at the printing unit 10 that has been put into an operating state, first, the separation and supply roller 46 rotates to separate one sheet of the recording paper P from the paper bundle B accommodated in the paper supply hopper 20, and conveys this recording paper P along the printing guide path 52 to the nipping roller pair 40 of the printing section 34. The nipping roller pair 40 nips the recording paper P, while rotating to feed the recording paper P in between the inkjet head 38 and the guide plate 44, convey the recording paper P along the guide plate 44 and insert a leading end portion of the recording paper P in between the pair of rollers 42. Hence, the recording paper P is nipped by the nipping roller pair 40 and the roller pair 42 and is conveyed in the sub-scanning direction at the sub-scanning speed.

While the inkjet head 38 is being moved in the main scanning direction by the head-driving mechanism, ink is selectively jetted/not jetted in accordance with the image data from the plurality of nozzles arranged in the main scanning direction, and an image is progressively formed by the ink on the recording paper P which is moving in the sub-scanning direction. As this image-recording operation by the inkjet head 38 proceeds, the roller pair 42 feeds a leading end side region of the recording paper P on which the image has been recorded into the paper ejection buffer 26. At this time, the stacking plate 28 in the paper ejection buffer 26 is restrained at the lower limit position thereof by the actuator. Therefore, the recording paper P is fed into the paper ejection buffer 26 by conveyance force from the roller pair 42 without the leading end portion of the recording paper P colliding with the separation and ejection roller 54, and when a trailing end portion of the recording paper P disengages from the roller pair 42, the recording paper P is accommodated in the paper ejection buffer 26.

Before the time at which the recording paper P on which the image has been recorded is accommodated in the paper ejection buffer 26, the control section 32 of the printing unit 10 judges whether or not to feed out this recording paper P from the paper ejection buffer 26 into the paper ejection guide path 66 immediately. This judgement is determined on the basis of various conditions such as, for example: whether or not recording paper P is being conveyed in the paper ejection course structured by the paper ejection guide paths 66 of the respective printing units 10; whether or not it is necessary, when the printing units 10 are performing printing of respectively different pages (image data) on the recording paper P, to alter an ejection timing of the recording paper P from in the paper ejection buffer 26 in order to first convey other recording paper P, on which an image of a page for which the number of pages is smaller is being recorded, from another of the printing units 10 to the paper ejection unit 70; and the like.

When the control section 32 of the printing unit 10 judges that the recording paper P is to be conveyed directly from the interior of the paper ejection buffer 26 into the paper ejection guide path 66, at the same moment as the recording paper P is accommodated in the paper ejection buffer 26, the stacking plate 28 is released from the lower limit position by the actuator. As a result, the stacking plate 28 is swung upward by the urging force of the urging member 30 and presses the leading end side of the recording paper P against the separation and ejection roller 54. At the same time, the control section 32 causes the separation and ejection roller 54 to start rotating and feed the recording paper P that was accommodated in the paper ejection buffer 26 into the branch guide path 60. At this time, in a case in which a plurality of sheets of the recording paper P have been stored in the paper ejection buffer 26 to structure a paper bundle B, the separation and ejection roller 54 separates only the one sheet of recording paper P that is at a topmost position from the paper bundle B and feeds this recording paper P into the branch guide path 60. The leading end side of the recording paper P that has been fed out to the branch guide path 60 is fed into the paper ejection guide path 66 by conveyance force from the separation and ejection roller 54. The leading end side of this recording paper P in the paper ejection guide path 66 is nipped by the conveyance roller pair 68, and the recording paper P is conveyed toward the paper ejection unit 70 by this conveyance roller pair 68.

Alternatively, if the control section 32 of the printing unit 10 judges that the recording paper P on which the image has been recorded is not to be conveyed directly from the paper ejection buffer 26 into the paper ejection guide path 66, the stacking plate 28 continues to be restrained at the lower limit position by the actuator after the recording paper P has been accommodated in the paper ejection buffer 26. Hence, subsequent recording paper P can be fed on which the image has been recorded by the inkjet head 38 into the paper ejection buffer 26 and stack this recording paper P on the recording paper P already stored in the paper ejection buffer 26.

In the printing apparatus 72, when the leading end side of the recording paper P at the printing unit 10 which is in the operational state is fed from the branch guide path 60 into the paper ejection guide path 66 and starts to be conveyed to the paper ejection unit 70 by the conveyance roller pair 68, the conveyance roller pairs 68 of printing units 10 that are disposed at the upper level side relative to that printing unit 10 and the conveyance roller pair 88 of the paper ejection unit 70 are respectively rotated. Thus, the recording paper P that has been fed into the paper ejection guide path 66 of the printing unit 10 which is in the operational state is successively conveyed toward the paper ejection unit 70 by the conveyance roller pairs 68 in the upper level side paper ejection guide paths 66, and is fed from the paper ejection guide path 66 of the printing unit 10 at the topmost level into the receiving guide path 86 of the paper ejection unit 70.

The recording paper P that has been fed into the receiving guide path 86 is conveyed toward the paper ejection aperture 84, and is nipped by the conveyance roller pair 88. The conveyance roller pair 88 nips the recording paper P while ejecting the recording paper P from the receiving guide path 86 through the paper ejection aperture 84 onto the paper ejection tray portion 78. When the trailing end portion of the recording paper P disengages from the conveyance roller pair 88, the recording paper P falls down and lands on the stacking face 80 of the paper ejection tray portion 78. At this time, because an incline is applied to the stacking face 80 so as to be lower toward the positioning face 82, the recording paper P that has fallen onto the stacking face 80 slides on the stacking face 80, or on recording paper P that has been stacked on the stacking face 80, the trailing end of the recording paper P abuts against the positioning face 82, and the recording paper P is positioned at a predetermined stacking position on the stacking face 80.

The above-described operation of recording an image on the recording paper P with the printing unit 10 may be implemented at only one of the printing units 10 to record an image on only one sheet of the recording paper P at a time, and may be respectively implemented at a plurality of the printing unit 10 (up to three in the present embodiment) to record images in a parallel manner on a plurality of sheets of the recording paper P at a time.

Next, operations of the printing unit 10 and the printing apparatus 72 relating to the present embodiment described above will be described.

In the printing unit 10 relating to the present embodiment, at a time of commencement of image recording by the printing section 34, the separation and supply roller 46 separates one sheet of the recording paper P from the paper bundle B stored in the paper supply hopper 20 and supplies the recording paper P to the printing section 34. Hence, the recording paper P, which was stored in the paper supply hopper 20 in the printing unit 10 beforehand, can be supplied to the printing section 34 and recording of an image by the printing section 34 can be commenced at the same time. Here, in comparison with a printing apparatus which supplies recording paper P to a printing section from outside the printing unit 10, a distance from a recording paper storage section, such as the paper supply hopper in which the recording paper P is stored or the like, to the printing section 34 (a conveyance distance) can be made shorter. Therefore, a duration from the commencement of conveyance of the recording paper P until the recording paper P reaches the printing section 34 (a paper supply duration) can be made shorter, and consequently a duration from input of a print command from a data processing device until image recording by the inkjet head 38 commences can be made shorter.

Further, in the printing unit 10, when recording paper P on which an image has been recorded by the printing section 34 is temporarily stored in the paper ejection buffer 26, and this recording paper P that has been temporarily stored in the paper ejection buffer 26 is separated by the separation and ejection roller 54 at a predetermined time, this recording paper P is conveyed along the paper ejection guide path 66 by the conveyance roller pairs 68 and is fed into the receiving guide path 86 of the paper ejection unit 70. Accordingly, when recording paper P on which an image has been recorded is temporarily stored in the paper ejection buffer 26, even though this recording paper P is not immediately ejected from the paper ejection buffer 26 into the paper ejection guide path 66 to commence conveyance along the paper ejection guide path 66 to the paper ejection unit 70, other, following, recording paper P can be supplied successively from the paper supply hopper 20 to the printing section 34 and commence image-recording on this recording paper P with the inkjet head 38. Therefore, even if, for example, the paper ejection guide path 66 is occupied by recording paper P on which an image has been recorded by another of the printing units 10, there is no need to interrupt image-recording operations on the recording paper P by this printing section 34. If conveyance of the recording paper that has been temporarily stored in this paper ejection buffer 26 to the paper ejection unit 70 is commenced at a time at which the paper ejection guide path 66 is vacated, this recording paper P can be ejected on which images have been recorded to the paper ejection unit 70 and stack the recording paper P on the paper ejection tray portion 78 of this paper ejection unit 70 without image-recording operations by the printing section 34 having been affected.

Thus, according to the printing unit 10 relating to the present embodiment, a duration from the input of a print command from a data processing device until the commencement of image-recording on the recording paper P can be shortened, and even when the paper ejection guide path 66 is occupied by a preceding recording paper P, there is no need to interrupt operations for recording images on the recording paper P with the printing section 34.

Consequently, at the printing apparatus 72 relating to the present embodiment, the duration can be shortened from input of a print command from a data processing device until commencement of image-recording on recording paper P by providing a plurality of the printing units 10, and there is no need to suspend operations for recording images on the recording paper P with the printing sections 34 even when the paper ejection guide paths 66 are occupied by preceding recording paper P. Thus, an average speed of printing on the recording paper P can be improved.

Furthermore, in the printing unit 10 of the present embodiment, the recording paper P on which images have been recorded by the printing section 34 can be stored in the paper ejection buffer 26 in large numbers and this recording paper P stored in the paper ejection buffer 26 can be separated one sheet at the time by the separation and ejection roller 54 and fed into the paper ejection guide path 66. Therefore, even when, for example, the paper ejection guide path 66 is occupied for a long time during ejection of recording paper P on which an image has been recorded by another of the printing units 10, operations can continue for recording images on numerous sheets of recording paper P in the remaining printing units 10.

At the printing apparatus 72, because printing speed (the number of sheets of recording paper on which images can be recorded per unit of time) of the device as a whole can be increased/decreased by increasing/decreasing the number of the printing units 10 that are stacked together with the paper ejection unit 70 to structure the device, printing capabilities, including printing speed, can be adjusted in wide ranges in accordance with the requirements of users. Here, at the printing unit 10, because the recording paper P on which images have been recorded by the printing section 34 is temporarily stored in the paper ejection buffer 26 and there is no need to interrupt operations for recording images on the recording paper P even when the paper ejection guide path 66 is occupied by preceding recording paper P, there is very little reduction in printing capability due to increases in waiting times when the number of printing units 10 is increased. Thus, when the number of the printing units 10 is increased, the printing capabilities can be increased effectively in correspondence with the increase in this number.

In the printing apparatus 72, the paper supply hopper 20 is provided respectively at each printing unit 10. Therefore, if, for example, respectively different kinds of recording paper P are stored in the paper supply hoppers 20 of the printing units 10 and printing is executed with the printing unit 10 at which a desired recording paper P is stored in the paper supply hopper 20, a desired recording paper P can be selected from among a number of kinds of recording paper P and have images recorded on that recording paper P automatically.

With the printing apparatus 72, because the printing apparatus 72 is structured by arranging the plurality of printing units 10 and the paper ejection unit 70 in a vertical direction and stacking the same, a space for disposition of the printing apparatus can be made smaller than with, for example, a structure in which an ejection section of the recording paper P is at a side relative to the printing units 10, or the like.

The paper ejection unit 70 is disposed at the topmost level of the printing apparatus 72 and the paper ejection tray portion 78, at which the recording paper P on which images have been recorded by the plurality of printing units 10 is stacked, is provided at the paper ejection unit 70. Consequently, in comparison with, for example, a case in which a paper ejection tray portion is disposed at a lower portion of a printing apparatus, a case in which paper ejection tray portions are individually provided in correspondence with a plurality of printing units or printing sections, or the like, with the printing apparatus 72 of the present embodiment users can more easily take image-recorded recording paper P that has been stacked in the paper ejection tray portion 78 out from that paper ejection tray portion 78 disposed at the upper portion of the printing apparatus 72.

In printing operations of each printing unit 10 (each printing section 34) in this printing apparatus 72, when the recording paper P stored in the paper supply hopper 20 is fed out by the separation and supply roller 46 to the supply path, which is structured by the lower guide path portion 52A and intermediate guide path portion 52B of the printing guide path 52, the recording paper P is guided toward the printing section 34 along the supply path, which extends in the vertical direction away from the paper supply hopper 20 toward the printing section 34 (i.e., toward one end of the transport path). The recording paper P is further fed in from the supply path to the transport path, which extends in the horizontal direction with the one end connecting with the supply path and is structured by the upper guide path portion 52C of the printing guide path 52, the sub-scanning guide path 45, the paper ejection buffer 26 and the branch guide path 60, and the recording paper P is guided along the transport path to the printing section 34. Then, the recording paper P that has been fed in to the printing section 34 is image-recorded by the printing section 34, and this image-recorded recording paper P is further guided along the transport path toward the ejection path, which connects with the other end of the transport path and is structured by the paper ejection guide path 66, and the recording paper P is fed out to the ejection path. The image-recorded recording paper P that has been fed out to the ejection path is guided along the ejection path, which extends in the vertical direction away from the printing section 34 (and the other end of the transport path) toward the paper ejection unit 70, toward the paper ejection unit 70 and is ejected by the conveyance roller pairs 68 and the conveyance roller pair 88 to the paper ejection tray portion 78 of the paper ejection unit 70.

If recording paper P becomes jammed during printing or during transport in the transport path in such a printing operation, processing of this jam is carried out by sliding the transport path portion, which includes the rear portion of the upper guide path portion 52C of the printing guide path 52, the sub-scanning guide path 45, the paper ejection buffer 26 and the front portion of the branch guide path 60. Here, the transport path portion, which is assembled to the upper face side of the sliding panel 300 together with the printing section 34 (the guide rod 36, the inkjet head 38, the head-driving mechanism, the nipping roller pair 40 and the roller pair 42), the separation and ejection roller 54 and the like, is rendered slideable in the direction (the direction of arrow D in FIG. 6) which substantially intersects the direction in which the transport path extends, together with the printing section 34 and the like, by the guide rails 302 provided between the casing 12 of the printing unit 10 and the sliding panel 300. By this sliding, the transport path portion can be moved between the through-path formation position, at which can guide the recording paper P by the transport path, and the through-path opening position, at which recording paper P that is disposed in the transport path can be extracted. Consequently, when the transport path portion is slid to move from the through-path formation position to the through-path opening position, as shown in FIG. 6, recording paper P that is stuck in the printing section 34 or the transport path is drawn out together with the printing section 34 and the transport path portion (FIG. 6 shows a state in which the recording paper P is stuck partway into the paper ejection buffer 26). Therefore, processing of this jam can be carried out with ease by a user or the like. Furthermore, because the inkjet head 38, the nipping roller pair 40, the roller pair 42 and the separation and ejection roller 54 are drawn out together with the transport path portion that includes the paper ejection buffer 26 and the like, maintenance such as supplying ink to the inkjet head 38, maintaining the actuator that drives the stacking plate 28 of the paper ejection buffer 26 and the like, and maintenance such as cleaning or replacing the respective rollers and the like, can be carried out with ease.

Further, in the present embodiment, the transport path portion is rendered slideable relative to the casing 12 by the pair of guide rails 302 which are provided between the sliding panel 300 to which the transport path portion is assembled and the casing 12 which structures the printing unit 10. Because these guide rails 302 are employed at the sliding portion, the sliding panel 300 (and the transport path portion) can be slid smoothly, and operability is excellent. Furthermore, because the stoppers which prevent the sliding panel 300 that has been drawn out to the through-path opening position from being drawn out further are incorporated at the guide rails 302, drawing out of the sliding panel 300 beyond a range of support by the guide rails 302 and accidental dropping and damaging of the sliding panel 300 can be avoided.

In the printing operation of the printing apparatus 72 relating to the present embodiment, if the recording paper P becomes jammed in the supply path provided in the printing unit 10, processing of this jam is carried out by cleaving a portion of the supply path. Herein, the intermediate guide path portion 52B of the printing guide path 52, which structures this supply path portion, can be cleaved along the vertical direction by opening of the opening/closing panel 304 which is openably/closeably attached to the casing 12 of the printing unit 10. By this cleaving, the intermediate guide path portion 52B can be set from the through-path formation state, in which can guide the recording paper P by the supply path, to the through-path opening state, in which recording paper P that is present in the supply path can be extracted. Thus, when the opening/closing panel 304 is opened and the supply path portion is cleaved along the vertical direction, from the through-path formation state to the through-path opening state, recording paper P that is stuck in the supply path is exposed, and processing of this jam can be carried out with ease by a user or the like.

Even in a case in which jammed recording paper P is disposed to straddle between the supply path and the printing section 34 (the transport path) or suchlike, the jam can be dealt with simply by opening the opening/closing panel 304 to cleave and open the supply path portion, without sliding the transport path portion. Therefore, the recording paper P that is disposed to straddle between the supply path and the printing section 34 will not be damaged by sliding of the transport path portion such that removal of a tom-off piece of the paper which is left at the supply path side becomes more difficult. Moreover, damage to the interior of the printing unit 10, the printing section 34 or the like by tensile forces acting through the recording paper P in accordance with such sliding can be prevented.

Jam processing of a case in which recording paper P becomes jammed in the ejection path is carried out by cleaving the ejection path. Herein, the paper ejection guide path 66 which structures the ejection path is rendered cleavable along the vertical direction by opening of the opening/closing panel 306 which is openably/closeably attached to the casing 12 of the printing unit 10. By this cleaving, the paper ejection guide path 66 can be set from the through-path formation state, in which can guide recording paper P by the ejection path, to the through-path opening state, in which recording paper P that is present in the ejection path can be extracted. Accordingly, when the opening/closing panel 306 is opened and the ejection path is cleaved along the vertical direction, from the through-path formation state to the through-path opening state, recording paper P that is stuck in the ejection path is exposed and a user or the like can carry out processing of this jam with ease (see FIG. 5).

Even in a case in which jammed recording paper P is disposed to straddle between the ejection path and the transport path or suchlike, the jam can be dealt with simply by opening the opening/closing panel 306 to cleave and open the ejection path, without sliding the transport path portion. Therefore, the recording paper P that is disposed to straddle between the ejection path and the transport path will not be damaged by sliding of the transport path portion such that removal of a torn-off piece of the paper which is left at the ejection path side becomes more difficult. Moreover, damage to the interior of the printing unit 10, the separation and ejection roller 54 or the like by tensile forces acting through the recording paper P in accordance with such sliding can be avoided.

Because the supply path portion and the ejection path can be cleft thus, maintenance operations such as cleaning the interior of the supply path and the interior of the ejection path, cleaning or replacement of the conveyance roller pairs 68 provided at the ejection path (i.e., the paper ejection guide path 66), and the like can also be carried out with ease.

In the present embodiment, a supply path-cleaving portion, which cleaves the supply path, is structured by the opening/closing panel 304. The supply path portion (the intermediate guide path portion 52B) is provided between the opening/closing panel 304 and the casing 12 which structures the main body of the printing unit 10, and the opening/closing panel 304 is openably/closeably attached to the casing 12. When the opening/closing panels 304 at the respective printing units 10 are respectively opened, the supply path portions respectively provided in correspondence with the printing sections 34 of the respective printing units 10 are individually cleaved.

Thus, because the opening/closing panels 304 are provided separately at each printing unit 10, for jam processing or maintenance operations of the supply paths provided in respective correspondence with the printing section 34 of each printing unit 10, for example, just the opening/closing panel 304 can be opened corresponding to a supply path in which a jam has occurred and perform jam processing or to open just the opening/closing panel 304 corresponding to a location requiring maintenance and perform a maintenance operation while, in parallel therewith, recording paper P is being supplied to the printing sections 34 that use supply paths that are in the through-path formation state due to others of the opening/closing panels 304 being in the closed state and images are being recorded on that recording paper P by the printing sections 34. Therefore, processing of such jams and maintenance operations can be carried out with reductions in throughput of the printing apparatus 72 being suppressed.

In the present embodiment, an ejection path-cleaving portion, which cleaves the ejection path, is structured by the opening/closing panel 306. The ejection path (the paper ejection guide path 66) is provided between the opening/closing panel 306 and the casing 12 which structures the main body of the printing unit 10, and the opening/closing panel 306 is openably/closeably attached to the casing 12. When the opening/closing panels 306 at the respective printing units 10 respectively open, the ejection paths respectively provided in correspondence with the printing sections 34 of the respective printing units 10 are individually cleaved.

Thus, because the opening/closing panels 306 are provided separately at each printing unit 10, for jam processing or maintenance operations of the ejection paths provided in respective correspondence with the printing section 34 of each printing unit 10, for example, just the opening/closing panel 306 can be opened corresponding to a supply path in which a jam has occurred and jam processing or opening of just the opening/closing panel 306 corresponding to a location requiring maintenance and a maintenance operation can be performed while, in parallel therewith, image-recorded recording paper P is being ejected to the paper ejection unit 70 from the printing sections 34 that use ejection paths that are in the through-path formation state due to others of the opening/closing panels 306 being in the closed state and images are being recorded on that recording paper P by the printing sections 34. Therefore, such jam processing and maintenance operations can be carried out with reductions in throughput of the printing apparatus 72 being suppressed.

In the present embodiment, jam processing of recording paper P that has jammed in the receiving guide path 86 of the paper ejection unit 70 and maintenance operations such as cleaning the interior of the receiving guide path 86 and the like can be carried out with ease by opening the opening/closing panel 308, which is openably/closeably attached to the casing 74 of the paper ejection unit 70.

Here, if one of the printing unit 10 and one of the paper ejection unit 70 are provided, for a minimal structure of the printing apparatus 72 relating to the present embodiment, the functions of recording images on recording paper P and stacking that recording paper P on the paper ejection tray portion 78 of the paper ejection unit 70 can be implemented.

Second Embodiment

Figure 7:
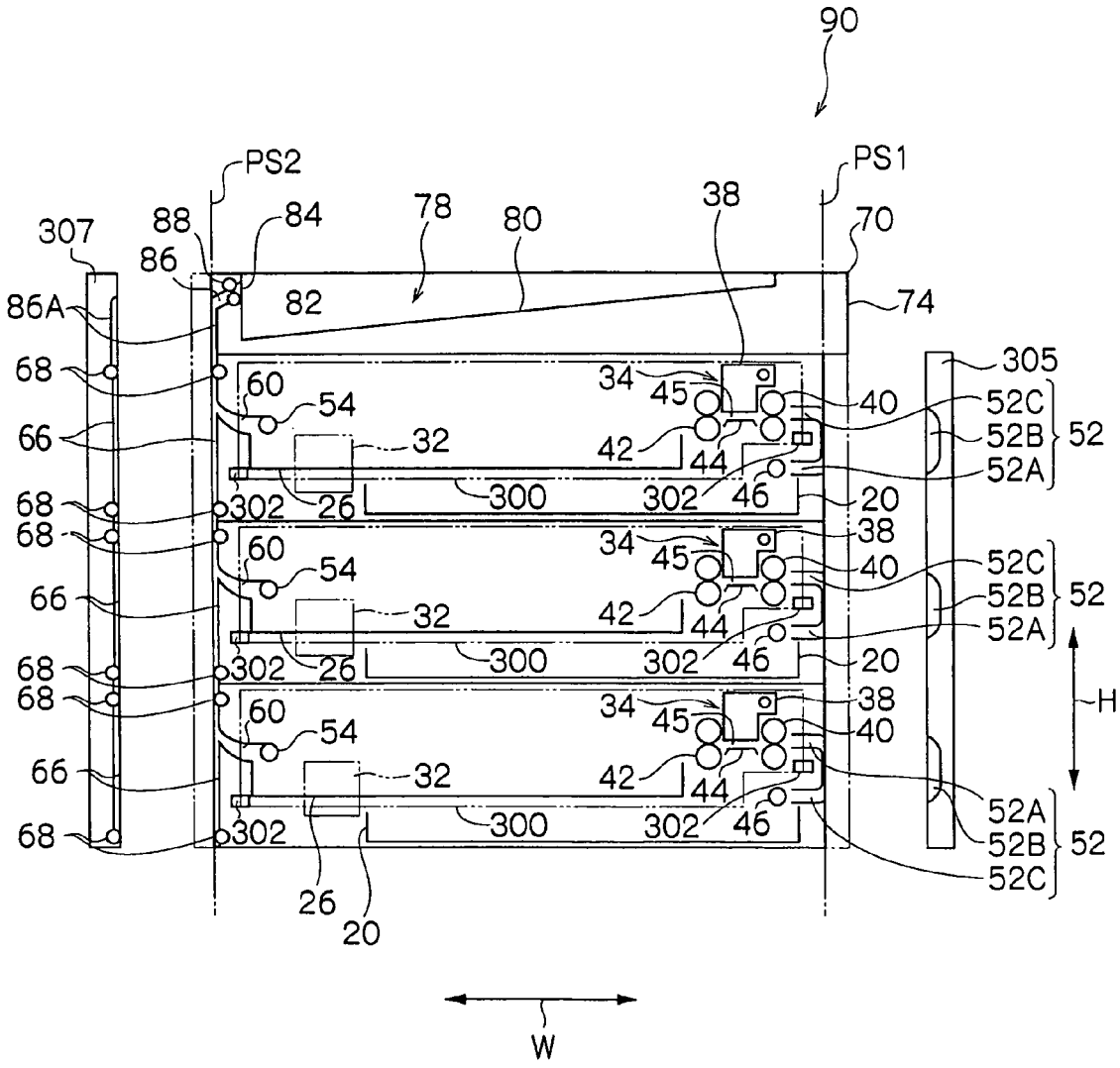
FIG. 7 is a side view showing structures for performing jam processing and maintenance of a supply path and an ejection path of a printing apparatus relating to a second embodiment of the present invention.

FIG. 7 shows a printing apparatus relating to a second embodiment of the present invention. As shown in FIG. 7, in a printing apparatus 90 of this embodiment, instead of the opening/closing panels 304 of the first embodiment, the opening/closing panels 304 of the respective printing units 10 are integrated and a single detachable panel 305, which is structured to be mountable and removable at the front faces of the casings 12 of the respective printing units 10, is provided at the front face side (the supply path side) of the printing units 10. Further, instead of the opening/closing panels 306 and the opening/closing panel 308 of the first embodiment, the opening/closing panels 306 of the respective printing units 10 and the opening/closing panel 308 of the paper ejection unit 70 are integrated and a single detachable panel 307, which is structured to be mountable and removable at the rear faces of the casings 12 of the respective printing units 10 and the casing 74 of the paper ejection unit 70, is provided at the rear face side (the ejection path side) of the printing units 10 and the paper ejection unit 70.

At this printing apparatus 90, when the detachable panel 305 is removed from the casings 12 of the respective printing units 10, the intermediate guide path portions 52B of the printing guide paths 52 provided at the respective printing units 10 are cleaved all together, and when the detachable panel 307 is removed from the casings 12 of the respective printing units 10 and the casing 74 of the paper ejection unit 70, the paper ejection guide paths 66 provided at the respective printing units 10 and the lower receiving guide path portion 86A of the receiving guide path 86 provided at the paper ejection unit 70 are cleaved all together.

Thus, at the printing apparatus 90 of the present embodiment, because the supply path-cleaving portions which cleave the supply paths of the respective printing units 10 are structured by the single detachable panel 305, the supply paths of the respective printing units 10 can be cleaved and exposed all at once simply by removing the detachable panel 305. Therefore, operability in cases such as maintenance of each supply path at the same time is excellent. Further, because the ejection path-cleaving portions which cleave the ejection paths of the respective printing units 10 are structured by the single detachable panel 307, in jam processing of the ejection paths of the respective printing units 10, finding and removing recording paper P which is, for example, disposed to straddle between a plurality of these ejection paths or finding and removing a plurality of sheets of the recording paper P which have become jammed at a plurality of locations of these ejection paths is simpler. Further still, because these ejection paths of the respective printing units 10 can be cleaved and exposed all at once simply by removing the detachable panel 307, operability in cases such as maintenance of each ejection path at the same time is excellent.

Here, the detachable panels 305 and 307 of the present embodiment may be formed in opening/closing forms. However, because a panel which is structured by a single panel extending across the plurality of printing units 10 is larger, if the panels are made in opening/closing forms, a larger amount of space will have to be reserved for opening the panels. In contrast, with the detachable panels 305 and 307 with mountable/removable forms as in the present embodiment, operations in a smaller space can be done.

Third Embodiment

Figure 8:
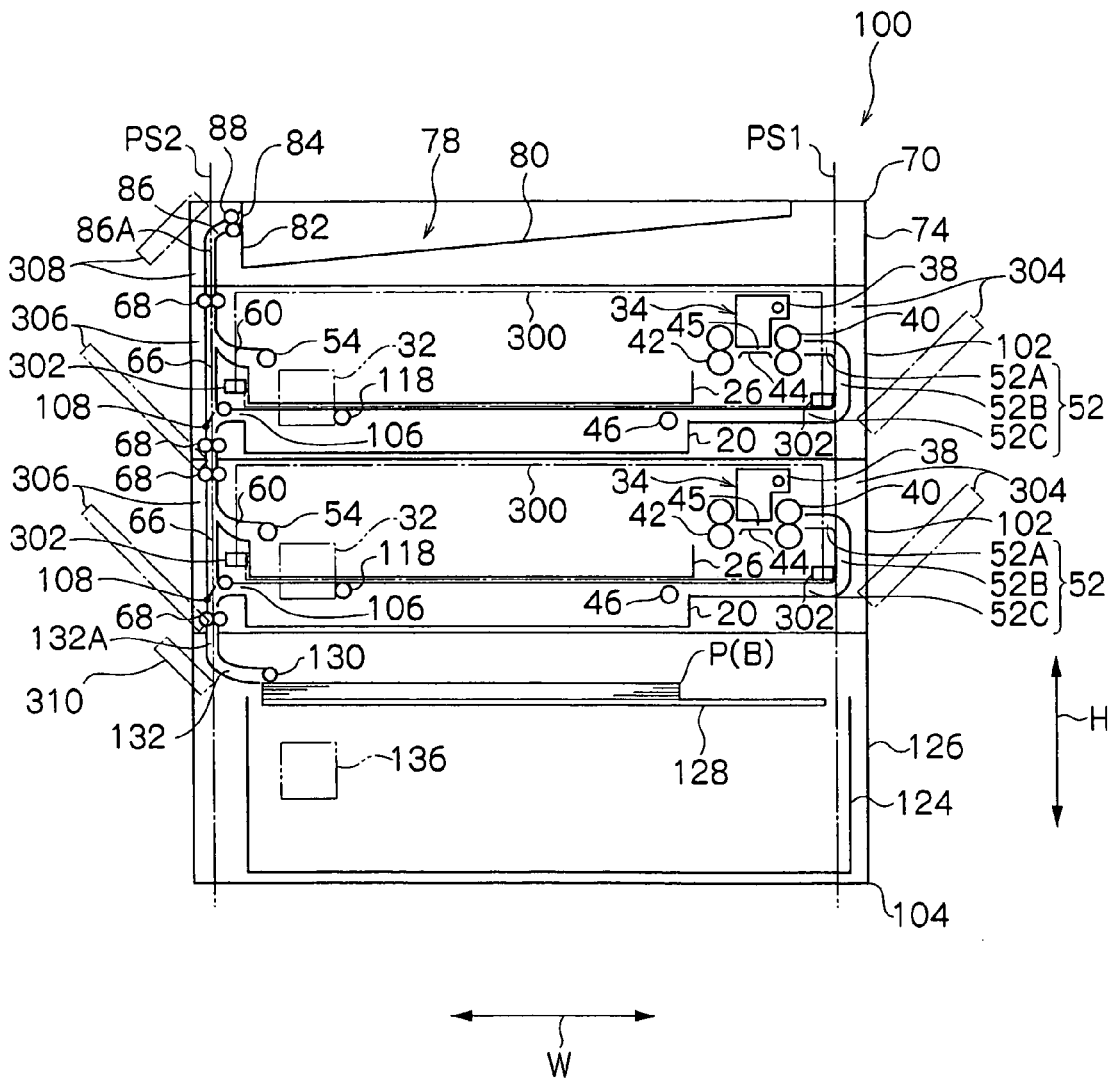
FIG. 8 is a side view showing structures for performing jam processing and maintenance of a supply path and an ejection path of a printing apparatus relating to a third embodiment of the present invention.
Figure 9:
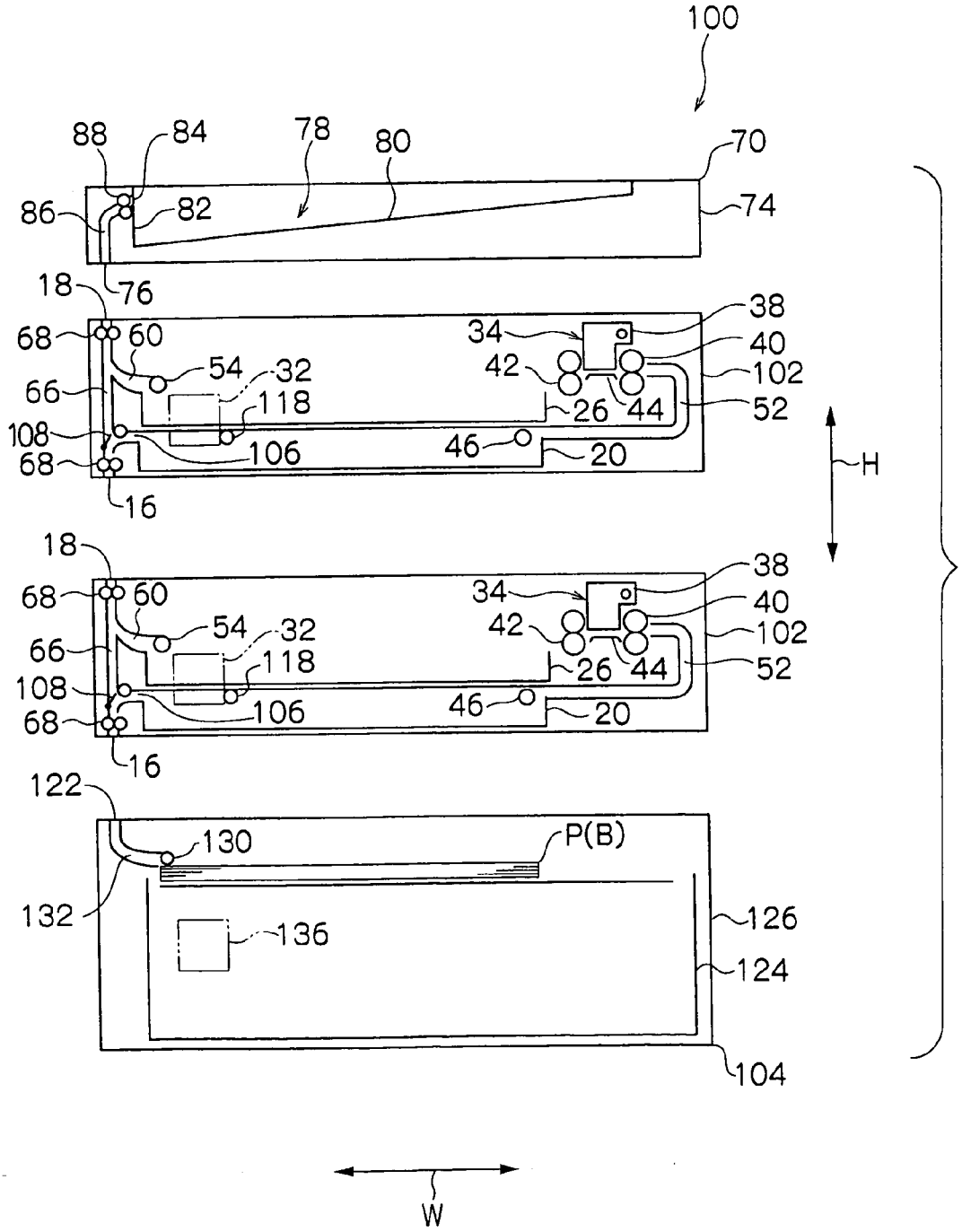
FIG. 9 is a side view showing a state in which the printing apparatus shown in FIG. 8 is broken up into unit pieces.
Figure 10A:
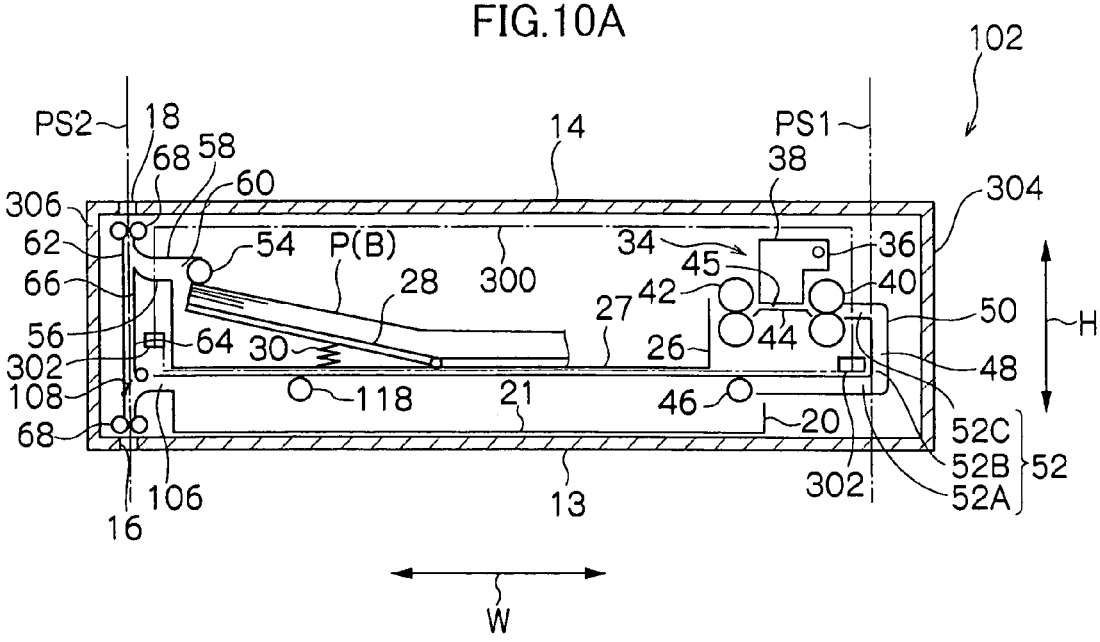
FIG. 10A is a side sectional view showing structure of a printing unit of the printing apparatus relating to the third embodiment of the present invention.
Figure 10B:
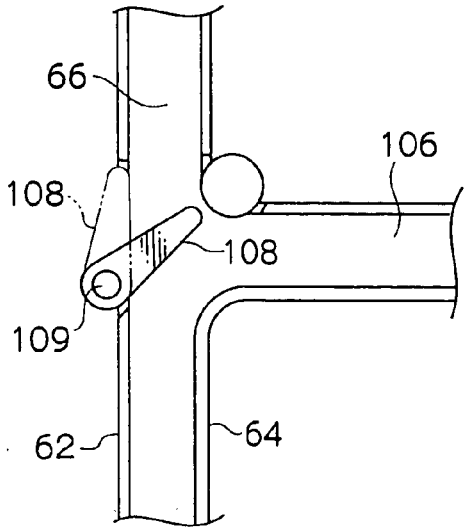
FIG. 10B is a side view showing operation of a guide lever of the printing unit.

FIGS. 8 and 9 show a printing apparatus relating to a third embodiment of the present invention, and FIGS. 10A and 10B show a printing unit employed in the printing apparatus relating to this embodiment. Note that for a printing apparatus 100 and a printing unit 102 relating to the present embodiment, portions that are common with those of the printing apparatus 72 and the printing unit 10 relating to the first embodiment are assigned the same reference numerals, and descriptions thereof are omitted.

A respect in which the printing apparatus 100 relating to the present embodiment differs from the printing apparatus 72 relating to the first embodiment is that, as shown in FIG. 8, a paper supply unit 104 is disposed at a lower side of the printing unit 102 that is at the lowest level. A respect in which the printing unit 102 relating to the present embodiment differs from the printing unit 10 relating to the first embodiment is that, as shown in FIGS. 10A and 10B, a branching guide path 106 and a guide lever 108 are respectively provided in each printing unit 102. The branching guide path 106 joins the paper ejection guide path 66 with the paper supply hopper 20, and the guide lever 108 is for selectively guiding recording paper P in the paper ejection guide path 66 into the branching guide path 106.

As shown in FIGS. 10A and 10B, the branching guide path 106, which branches toward the paper supply hopper 20 from a lower end portion of the paper ejection guide path 66, is provided in the printing unit 102. A distal end portion of this branching guide path 106 opens into the paper supply hopper 20, and recording paper P which is fed out through the distal end portion of the branching guide path 106 is stored in the paper supply hopper 20.

Figure 11A:
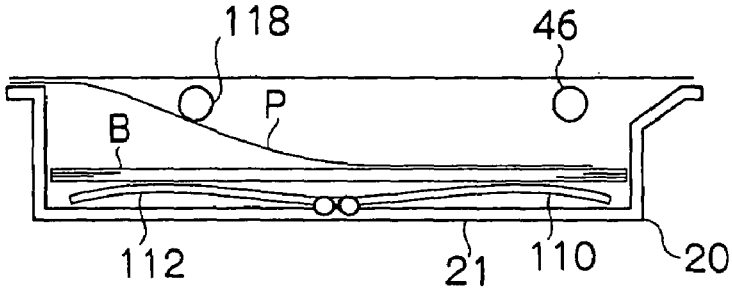
FIG. 11A is a side view showing structure of a paper supply unit of the printing unit shown in FIG. 10A, showing a state in which stacking plates are restrained at lower limit positions.
Figure 11B:
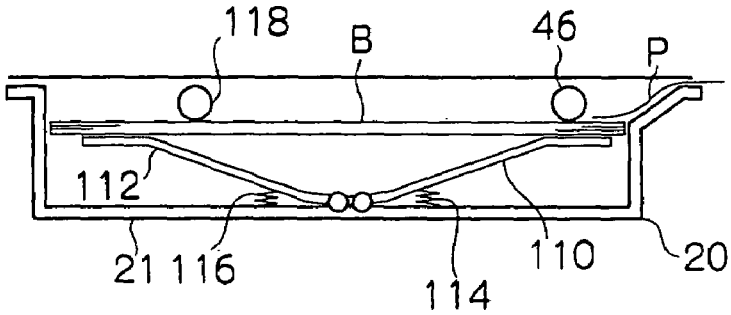
FIG. 11B shows a state in which the stacking plates of FIG. 11A are released from the lower limit positions.

As shown in FIGS. 11A and 11B, a pair of stacking plates 110 and 112 are disposed adjacent to one another along the breadth direction on the bottom plate portion 21 in the paper supply hopper 20. Respective breadth direction central side end portions of these stacking plates 110 and 112 are swingably coupled to the bottom plate portion 21. Hence, a leading end side region of recording paper P (a paper bundle B) that is stored in the paper supply hopper 20 is placed on the stacking plate 110, and a trailing end side region of the same is placed on the stacking plate 112. Swinging end sides of the stacking plates 110 and 112 are respectively urged upward by urging members 114 and 116, such as coil springs or the like (see FIG. 11B). Further, in this printing unit 102, the separation and supply roller 46 and a pressing roller 118 are respectively disposed above the paper supply hopper 20. The separation and supply roller 46 is supported so as to oppose a distal end portion of the stacking plate 110 and the pressing roller 118 is supported so as to oppose a central portion of the stacking plate 112.

Actuators (not shown) are provided at the paper supply hopper 20 for moving the stacking plates 110 and 112 downward in the directions of swinging, in opposition to the urging members 114 and 116, and restraining the stacking plates 110 and 112 at lower limit positions thereof. When recording paper P is to be received into the paper supply hopper 20 from the branching guide path 106, as shown in FIG. 11A, these actuators swing and restrain the pair of stacking plates 110 and 112 to the lower limit positions, which are each close to the bottom plate portion 21, and respectively release the pair of stacking plates 110 and 112 after reception of the recording paper P into the paper supply hopper 20 has been completed. Hence, the stacking plates 110 and 112 are swung upward by urging forces from the urging members 114 and 116 and, as shown in FIG. 11B, a leading end portion of the recording paper P is pressed against the separation and supply roller 46 and a trailing end side of the recording paper P is pressed against the pressing roller 118. The actuators also swing and restrain the stacking plates 110 and 112 to the lower limit positions when the paper supply hopper 20 is being slid from the mounted position to the supply position.

In the printing unit 102, the guide lever 108 is provided in the vicinity of a branching point of the paper ejection guide path 66 and the branching guide path 106. As shown in FIG. 10B, a support axis portion 109, which is a center of swinging, is provided at one end portion of this guide lever 108. This support axis portion 109 is axially supported by an axle portion (not shown), which is disposed at an outer side of the one paper ejection guide plate 62. Here, the guide lever 108 is set to be rotatable in a range between a paper supply position, shown by solid lines, and a paper ejection position, shown by broken lines. The guide lever 108 is coupled to a rotary actuator (not shown), and is rotated and held at either of the paper supply position and the paper ejection position by this rotary actuator.

As mentioned above, the printing apparatus 100 is provided with the paper supply unit 104 at a lowermost level, and the printing apparatus 100 is structured by stacking the printing units 102 and the paper ejection unit 70 on this paper supply unit 104. Herein, the paper supply unit 104 is a unit for supplying recording paper P into the paper supply hoppers 20 of the respective printing units 102.

As shown in FIG. 8, the paper supply unit 104 is provided with a casing 126, which serves as an outer shell portion. Sizes along the breadth direction and the depth direction of this casing 126 are substantially the same as those of the casing 12 of the printing unit 102. At the casing 126, a slit-form paper discharge aperture 122 (see FIG. 9) is opened at a rear end side of an upper face portion of the casing 126. This paper discharge aperture 122 connects with the paper supply aperture 16 of the printing unit 102 that is adjacent to the paper supply unit 104 at the upper level side thereof.

A main paper supply hopper 124, which is formed to be capable of storing a paper bundle B in which a number of sheets of the recording paper P are stacked, is provided inside the casing 126. This main paper supply hopper 124, similarly to the paper supply hopper 20 of each printing unit 102, is supported by the casing 126 to be slideable along the depth direction between a mounted position and a supply position. Here, when the main paper supply hopper 124 slides from the mounted position in the casing 126 to the supply position, an opening portion of an upper face side of the main paper supply hopper 124 is put into an open state, and recording paper P (a paper bundle B) can be supplied or taken out through this opening portion.

A stacking tray 128 and a raising/lowering mechanism (not shown) are provided in the main paper supply hopper 124. The accommodated paper bundle B is stacked on the stacking tray 128, and the raising/lowering mechanism supports this stacking tray 128 to be raiseable and lowerable in a height direction. A separation and supply roller 130 is also provided inside the casing 126, above the main paper supply hopper 124. This separation and supply roller 130 is supported such that a roller face thereof opposes a leading end portion of an upper face of the paper bundle B which is stacked on the stacking tray 128. In conjunction with sliding of the main paper supply hopper 124 from the mounted position to the supply position, the raising/lowering mechanism moves the stacking tray 128 to a lower limit position which is near a bottom plate portion of the casing 126. In conjunction with sliding of the main paper supply hopper 124 from the supply position to the mounted position, the raising/lowering mechanism lifts the stacking tray 128 and presses the paper bundle B on the stacking tray 128 against the separation and supply roller 130 with a predetermined pressing force.

As shown in FIG. 8, a connection guide path 132 is provided in the casing 126. The connection guide path 132 extends from the paper discharge aperture 122 toward the separation and supply roller 130. A distal end portion of this connection guide path 132 opens to face the portion of the separation and supply roller 130 that presses against the paper bundle B. Hence, when the separation and supply roller 130 rotates to the extent of a predetermined amount, one sheet of recording paper P is separated from the paper bundle B on the stacking tray 128 by the separation and supply roller 130, and a leading end side of this recording paper P is fed into the connection guide path 132.

Here, the stacking tray 128 provided in the main paper supply hopper 124 is not limited to a single tray. A plurality of the stacking tray 128 may be provided in the main paper supply hopper 124, with respectively different types of recording paper P being stacked in each stacking tray 128. In such a case, one type of recording paper P selected from the plurality of types of recording paper P can be fed into the connection guide path 132 by, for example, as well as moving the plurality of stacking trays 128 in the vertical direction with the raising/lowering mechanism, moving the plurality of stacking trays 128 in the front-rear direction (the breadth direction) to selectively press the paper bundle B stacked in any of the plurality of stacking trays 128 against the separation and supply roller 130.

A plurality of guide protrusions (not shown) are provided protruding upward at a top plate portion of the casing 126 of the paper supply unit 104. These guide protrusions are disposed to respectively correspond with a plurality of guide-receiving portions (not shown) of the printing unit 102, just as the same as being provided at the printing unit 10. In the state in which the printing apparatus 100 is structured by stacking the printing units 102 and the paper ejection unit 70 on the paper supply unit 104, the guide protrusions of the paper supply unit 104 are inserted into the guide-receiving portions of the printing unit 102 at the upper level side thereof. Thus, the paper supply unit 104, the printing units 102 and the paper ejection unit 70 are positioned so as to align with one another along the breadth direction and the depth direction, and are integrated by movement between the units 102, 70 and 104 being restricted.

Similarly to the printing units 102, the paper supply unit 104 is provided with a control section 136. This control section 136 is electrically connected with the other control sections 32 of the printing units 102. A structure for electrically connecting the control section 136 of the paper supply unit 104 with the control sections 32 of the printing units 102 can be, similarly to connections between the control sections 32 of the printing units 102, a connection by a cable and a socket, a connection by a guide protrusion and guide-receiving portion serving as a connector and a socket, respectively, or the like.

In the printing apparatus 100 relating to the present embodiment, the single paper ejection course which is structured by connecting the paper ejection guide paths 66 of the respective printing units 102 structures a portion of a paper supply course for supplying the recording paper P from the paper supply unit 104 to each printing unit 102. That is, in the printing apparatus 100, the paper supply course is structured by the paper ejection guide paths 66 and the branching guide paths 106 of the printing units 102.

At the printing apparatus 100 relating to the present embodiment too, simply by lifting up the units 70 and 102 at an upper level side, they can be easily separated from the units 104 and 102 at a lower level side, as shown in FIG. 9. Accordingly, if the printing apparatus 100 is put into a state in which one of the printing units 102 is separated from another of the printing units 102 or the paper ejection unit 70 is separated from the printing unit 102 at the lower level side thereof, one or a number of the printing units 102 can be inserted between the one printing unit 102 and the other printing unit 102 or between the printing unit 102 and the paper ejection unit 70, or to take out one or a number of the printing units 102 from between those printing units 102 or from between the printing unit 102 and the paper ejection unit 70. Thus, at the printing apparatus 100, the number of the printing units 102 that structure the device can be easily increased/reduced, and the printing capabilities of the device can be adjusted as a whole, including printing speeds, by increasing/reducing the number of printing units 102.

Next, structures for performing recording paper P jam processing and maintenance of the printing apparatus 100 provided with the printing units 102, the paper supply unit 104 and the paper ejection unit 70 of the present embodiment will be described using FIG. 8.

Structures for performing recording paper P jam processing and maintenance of the supply path, the transport path and the ejection path of each printing unit 102 of the printing apparatus 100 are basically the same as the structures for performing recording paper P jam processing and maintenance of the supply path, transport path and ejection path of each printing unit 10 of the printing apparatus 72 relating to the first embodiment.

In the printing unit 102, the structure for performing recording paper P jam processing and maintenance of the transport path is a structure which is capable of sliding the transport path portion relative to the casing 12 of the printing unit 102 in the depth direction, which is the direction substantially intersecting the direction in which the transport path extends (the horizontal direction), between the mounted position (closed position) and the open position. This transport path portion, the same as in the first embodiment, includes the rear portion of the upper guide path portion 52C of the printing guide path 52, the sub-scanning guide path 45, the paper ejection buffer 26 and the front portion of the branch guide path 60. The transport path portion is assembled to the upper face side of the sliding panel 300, together with the printing section 34, the separation and ejection roller 54 and the like, which are also assembled to the upper face side of the sliding panel 300, and these members are formed into a unit. The front end portion and rear end portion of the sliding panel 300 are attached to the casing 12 via the pair of guide rails 302, and the sliding panel 300 is rendered slideable along the depth direction relative to the casing 12 by this pair of guide rails 302.

In the printing unit 102, the structure for performing recording paper P jam processing and maintenance of the supply path is a structure at which the supply path portion (the intermediate guide path portion 52B of the printing guide path 52) is set to be cleavable along the vertical direction. The same as in the first embodiment, the opening/closing panel 304 is provided at the front face of the casing 12 of the printing unit 102, the supply path portion is provided between the opening/closing panel 304 and the casing 12, and the supply path portion is cleaved and opened by opening of the opening/closing panel 304.

In the printing unit 102, the structure for performing recording paper P jam processing and maintenance of the ejection path, which includes the paper supply course for the recording paper P from the paper supply unit 104 to the paper supply hopper 20, is a structure at which the ejection path (the paper ejection guide path 66) is made cleavable along the vertical direction. The same as in the first embodiment, the opening/closing panel 306 is provided at the rear face of the casing 12 of the printing unit 102, the ejection path, including the aforementioned portion of the paper supply course for supplying the recording paper P to each printing unit 102 from the paper supply unit 104, is provided between the opening/closing panel 306 and the casing 12, and the ejection path is cleaved and opened by opening of the opening/closing panel 306.

Further, in the printing apparatus 100 of the present embodiment, structure for performing recording paper P jam processing and maintenance of the connection guide path 132 of the paper supply unit 104 is also provided. This structure for performing recording paper P jam processing and maintenance of the connection guide path 132 is basically the same as the structure for performing recording paper P jam processing and maintenance of the receiving guide path 86 of the paper ejection unit 70, being a structure at which a portion of the connection guide path 132 is made cleavable along a vertical direction.

An opening/closing panel 310 is provided at the paper supply unit 104, at an upper end portion of a rear face of the casing 126. An upper connection guide path portion 132A, which is provided extending substantially vertically to structure an upper portion side of the connection guide path 132, is provided between the opening/closing panel 310 and the casing 126. This upper connection guide path portion 132A, being a portion of the connection guide path 132, is cleaved and opened by opening of the opening/closing panel 310.

Next, operations by the printing apparatus 100 relating to the present embodiment, which is structured as described above, will be described.

Operations of recording images on recording paper P with each printing unit 102 of the printing apparatus 100 are basically common with operations of recording images on recording paper P with the printing apparatus 72 relating to the first embodiment, and descriptions thereof are omitted. However, in the printing unit 102 relating to the present embodiment, when the recording paper P stored in the paper supply hopper 20 is to be supplied to the printing section 34, the recording paper P (paper bundle B), which is urged by the pair of stacking plates 110 and 112, is pressed against the separation and supply roller 46 and the pressing roller 118. At a time of supply of recording paper P from the paper supply hopper 20 to the printing section 34, one sheet of recording paper P is separated from the paper bundle B stored in the paper supply hopper 20 and fed into the printing guide path 52 by the separation and supply roller 46 rotating by a predetermined amount. Here, when the topmost one sheet of recording paper P is separated from the paper bundle B by the separation and supply roller 46, the pressing roller 118 functions as a resistance roller for preventing movement of a second and lower sheets of the recording paper P.

In the printing apparatus 100 of the present embodiment, because, compared to the printing apparatus 72 of the first embodiment, the paper supply unit 104 has been added, recording paper P from the paper supply unit 104 can be supplied into the paper supply hopper 20 of each printing unit 102. This operation of supply from the paper supply unit 104 to the paper supply hopper 20 will now be described.

If, in accordance with the volume of a print command from a data processing device, an amount of recording paper P remaining in the paper supply hopper 20 and the like, the control section 32 of the printing unit 102 judges that supply of recording paper P from the paper supply unit 104 is necessary, and judges that supply from the paper supply unit 104 can be performed, the control section 32 prepares for receiving the recording paper P from the paper supply unit 104 and sends a request to the paper supply unit 104 for the supply of recording paper P. Here, cases in which the control section 32 judges that the supply of recording paper P from the paper supply unit 104 is necessary include a case in which the amount of recording paper P remaining in the paper supply hopper 20 is small and a case in which it is necessary, according to a print command, to record images on the recording paper P that is stored in the paper supply unit 104.

The control section 32 judges that recording paper P can be supplied from the paper supply unit 104 to the paper supply hopper 20 when image recording is not being carried out on recording paper P by the printing section 34 and the paper ejection guide path(s) 66 (the paper supply course) between the paper supply unit 104 and the paper supply hopper 20 is not occupied by recording paper P.

When the control section 32 judges that the supply of recording paper P from the paper supply unit 104 is necessary and judges that supply from the paper supply unit 104 can be performed, first, the stacking plates 110 and 112 are respectively swung to the lower limit positions by the actuators and restrained, and the guide lever 108 is turned from the paper ejection position to the paper supply position by the rotary actuator (see FIG. 10B).

Then, the control section 32 causes the commencement of rotation of each conveyance roller pair 68 disposed at the paper ejection guide path(s) 66 between the paper supply unit 104 and the printing supply hopper 20 in respective predetermined conveyance directions, and sends a paper supply signal to the control section 136 of the paper supply unit 104. When the control section 136 of the paper supply unit 104 receives this paper supply signal, the control section 136 rotates the separation and supply roller 130 by a predetermined amount. In consequence, one sheet of recording paper P is separated from the paper bundle B stacked on the stacking tray 128 and is fed into the connection guide path 132. A leading end side of this recording paper P passes along the connection guide path 132, is fed into the paper ejection guide path 66, and is nipped and conveyed by the conveyance roller pair(s) 68. When the recording paper P has been conveyed to the point of branching between the paper ejection guide path 66 and the branching guide path 106, the recording paper P is guided from the paper ejection guide path 66 into the branching guide path 106 by the guide lever 108. This recording paper P is fed out into the paper supply hopper 20 by conveyance force from the conveyance roller pair(s) 68, and is stored on the stacking plates 110 and 112.

If the control section 136 of the paper supply unit 104 is requested for a plurality of sheets of recording paper P by the paper supply signal from the control section 32, the control section 136 repeats the separation and paper supply operation, rotating the separation and supply roller 130 to feed succeeding recording paper P into the connection guide path 132 at the same time as preceding supplied recording paper P is being accommodated in the paper supply hopper 20, for the number of sheets of recording paper P that has been requested.

When the number of sheets of recording paper P requested by the paper supply signal has been stored in the paper supply hopper 20, the control section 32 of the printing unit 102 releases the stacking plates 110 and 112 from the lower limit positions thereof with the respective actuators, and returns the guide lever 108 from the paper supply position to the paper ejection position with the rotary actuator. Hence, in the printing unit 102, the recording paper P that has been supplied from the paper supply unit 104 can be supplied, with precedence, from inside the paper supply hopper 20 to the printing section 34, and recording paper P that is fed into the paper ejection guide path 66 from the printing unit 102 can be conveyed to the paper ejection unit 70.

Next, operations of the printing unit 102 and printing apparatus 100 relating to the present embodiment as described above will be described.

At the printing unit 102 relating to the present embodiment, similarly to the printing unit 10 relating to the first embodiment, a duration from commencing conveyance of recording paper P from a recording paper storage portion, such as a paper supply hopper which stores recording paper P or the like, until the recording paper P reaches the printing section 34 (the paper supply duration) can be made shorter than in a printing apparatus in which recording paper P is supplied from outside the printing unit 102. Therefore, a duration from input of a print command from a data processing device until the commencement of recording of an image on the recording paper P by the inkjet head 38 can be made shorter. Moreover, even if the paper ejection guide path 66 is occupied by recording paper P on which images have been recorded by another printing unit 102, it is not necessary to interrupt operations of recording images on the recording paper P by the printing section 34. If the recording paper P is temporarily stored in the paper ejection buffer 26 and conveyance to the paper ejection unit 70 commences when the paper ejection guide path 66 has been vacated, recording operations by the printing section 34 will not be affected, and the recording paper P on which images have been recorded can be ejected to the paper ejection unit 70 and stacked on the paper ejection tray portion 78.

Thus, with the printing unit 102 relating to the present embodiment too, the duration from the input of a print command from a data processing device until the commencement of image-recording on the recording paper P can be shortened, and even when the paper ejection guide path 66 is occupied by a preceding recording paper P, there is no need to interrupt operations for recording images on the recording paper P with the printing section 34.

Consequently, in the printing apparatus 100 relating to the present embodiment, the duration can be shortened from input of a print command from a data processing device until commencement of image-recording on the recording paper P by providing a plurality of the printing units 102, and there is no need to suspend operations for recording images on the recording paper P with the printing section 34 when the paper ejection guide path 66 is occupied by preceding recording paper P. Thus, an average speed of printing on the recording paper P can be improved and, when the number of the printing units 102 is increased, the printing capabilities can be increased effectively in correspondence with the increase in this number.

In the printing apparatus 100 of the present embodiment, at certain times, recording paper P is fed into the paper ejection guide path 66 by the paper supply unit 104, passes along the paper ejection guide path(s) 66 and the branching guide path 106, is fed into the paper supply hopper 20 of the printing unit 102, and is accommodated in the paper supply hopper 20. Therefore, provided recording paper P is preparatorily stored in the main paper supply hopper 124 of the paper supply unit 104, recording paper can be automatically supplied from the main paper supply hopper 124 into the paper supply hoppers 20 in accordance with requests from the control sections 32 of the printing units 102. Therefore, there is no need, for example, for recording paper P to be supplied to the paper supply hopper 20 of the printing unit 102 by a manual operation by an operator while the printing unit 102 or the printing apparatus 100 is stopped. As a result, an amount of time for which the printing unit or the printing apparatus is stopped for the supply of recording paper P can be reduced. Thus, average capabilities for printing on recording paper P can be improved.

In the printing apparatus 100 relating to the present embodiment, the paper supply hopper 20 is provided at each printing unit 102. Thus, if, for example, respectively different kinds of recording paper P are stored in the main paper supply hopper 124 of the paper supply unit 104 and the paper supply hoppers 20 of the printing units 102, when it is necessary to record images on recording paper P of the different kind, the recording paper P of the different kind can be supplied from the main paper supply hopper 124 to the paper supply hoppers 20 and images can be recorded on this recording paper P by the printing sections 34. Furthermore, if it is made possible to select one kind of recording paper P from a plurality of kinds of recording paper P and supply that kind from the paper supply unit 104 to the printing units 102, images can be recorded automatically with the printing sections 34 of the printing units 102 on an even greater number of kinds of recording paper P.

Further, with the printing unit 102 relating to the present embodiment, the paper supply guide path for guiding the recording paper P supplied from the paper supply unit 104 into the paper supply hoppers 20 of the printing units 102 is structured, apart from the branching guide path 106 portions, by the paper ejection guide paths 66. Therefore, it is not necessary to provide the whole of the paper supply guide path for guiding recording paper P from the paper supply unit 104 to the paper supply hoppers 20 separately from the paper ejection guide paths 66. Thus, structure of the printing unit 102 including the paper ejection guide path 66 and the paper supply guide path can be simplified.

At the printing apparatus 100, because the printing apparatus 100 is structured by arranging and stacking the plurality of printing units 102, the paper supply unit 104 and the paper ejection unit 70 in a vertical direction, a footprint of the printing apparatus can be made smaller than, for example, a device which is structured by disposing a storage section and/or ejection section for recording paper P to a side relative to the printing units 102.

Further, at this printing apparatus 100, the main paper supply hopper 124, which collectively stores common recording paper P which can be supplied to the plurality of printing units 102, is provided at the paper supply unit 104 which is disposed at a lowermost level. Weight of the paper supply unit 104 is increased in a state in which a large number of sheets of recording paper P are stored in the main paper supply hopper 124. Because this paper supply unit 104, which constitutes a weight portion, is disposed at a lower portion of the printing apparatus 100, stability and durability of the printing apparatus as a whole can be improved.

At each printing unit 102, if, in a printing operation, recording paper P becomes jammed during printing or during feeding in the transport path, processing of this jam can be performed with ease by sliding the transport path portion, which includes the rear portion of the upper guide path portion 52C of the printing guide path 52, the sub-scanning guide path 45, the paper ejection buffer 26 and the front portion of the branch guide path 60. Furthermore, because the inkjet head 38, the nipping roller pair 40, the roller pair 42 and the separation and ejection roller 54 are drawn out together with the transport path portion that includes the paper ejection buffer 26 and the like by this sliding, maintenance such as supplying ink to the inkjet head 38, maintaining the actuator that drives the stacking plate 28 of the paper ejection buffer 26 and the like, and maintenance such as cleaning or replacing the respective rollers and the like, can be carried out with ease.

At each printing unit 102, if recording paper P becomes jammed in the supply path during a printing operation, processing of this jam can be carried out with ease by opening the opening/closing panel 304 which is openably/closeably attached to the casing 12 of the printing unit 102.

Even in a case in which jammed recording paper P is disposed to straddle between the supply path and the printing section 34 (the transport path) or suchlike, the jam can be dealt with by opening the opening/closing panel 304, without sliding the transport path portion. Therefore, the recording paper P that is disposed to straddle between the supply path and the printing section 34 will not be damaged by sliding of the transport path portion such that removal of a torn-off piece of the paper which is left at the supply path side becomes more difficult. Moreover, damage to the interior of the printing unit 102, the printing section 34 or the like by tensile forces acting through the recording paper P in accordance with such sliding can be avoided.

Further, at each printing unit 102, jam processing of a case in which recording paper P becomes jammed in the ejection path during a printing operation can be carried out with ease by opening the opening/closing panel 306 which is openably/closeably attached to the casing 12 of the printing unit 102.

Even in a case in which jammed recording paper P is disposed to straddle between the ejection path and the transport path or suchlike, the jam can be dealt with simply by opening the opening/closing panel 306, without sliding the transport path portion. Therefore, the recording paper P that is disposed to straddle between the ejection path and the transport path will not be damaged by sliding of the transport path portion such that removal of a torn-off piece of the paper which is left at the ejection path side becomes more difficult. Moreover, damage to the interior of the printing unit 102, the separation and ejection roller 54 or the like by tensile forces acting through the recording paper P in accordance with such sliding can be avoided.

Because it is possible to cleave the supply path portion and the ejection path thus, maintenance operations such as cleaning the interior of the supply path and the interior of the ejection path, cleaning or replacement of the conveyance roller pairs 68 and the guide lever 108 provided at the ejection path (i.e., the paper ejection guide path 66), and the like can also be carried out with ease.

In the present embodiment, jam processing of recording paper P that has jammed in the connection guide path 132 of the paper supply unit 104 and maintenance operations, such as cleaning of the interior of the connection guide path 132 and the like, can be carried out with ease by opening the opening/closing panel 310 which is openably/closeably attached to the casing 126 of the paper supply unit 104.

In the present embodiment too, the supply path-cleaving portion, which cleaves the supply path, is structured by the opening/closing panel 304, the supply path portion (the intermediate guide path portion 52B) is provided between the opening/closing panel 304 and the casing 12 which structures the main body of the printing unit 10, and the opening/closing panel 304 is openably/closeably attached to the casing 12. The ejection path-cleaving portion, which cleaves the ejection path, is structured by the opening/closing panel 306, the ejection path (the paper ejection guide path 66) is provided between the opening/closing panel 306 and the casing 12 which structures the main body of the printing unit 10, and the opening/closing panel 306 is openably/closeably attached to the casing 12. When the opening/closing panels 304 and 306 at the respective printing units 10 are respectively opened, the supply path portions and ejection paths respectively provided in correspondence with the printing sections 34 of the respective printing units 10 are individually cleaved. Thus, it is possible to open just the opening/closing panel 304 or 306 corresponding to a supply path or ejection path in which a jam has occurred and perform jam processing or to open just the opening/closing panel 304 or 306 corresponding to a location requiring maintenance and perform a maintenance operation while, in parallel therewith, images are being recorded on recording paper P by the printing sections 34 that use supply paths that are in the through-path formation state due to others of the opening/closing panels 304 being in the closed state or ejection paths that are in the through-path formation state due to others of the opening/closing panels 306 being in the closed state, recording paper P is being supplied to these printing sections 34 and image-recorded recording paper P is being ejected to the paper ejection unit 70 from these printing sections 34. Therefore, processing of such jams and maintenance operations can be carried out with reductions in throughput of the printing apparatus 100 being suppressed.

Here, if one each of the paper supply unit 104, the printing unit 102 and the paper ejection unit 70 are provided, for a minimal structure of the printing apparatus 100 relating to the present embodiment, the functions of recording images on recording paper P and stacking that recording paper P on the paper ejection tray portion 78 of the paper ejection unit 70 and the function of supplying the recording paper P from the paper supply unit 104 to the printing unit 102 can all be implemented.

Fourth Embodiment

Figure 12:
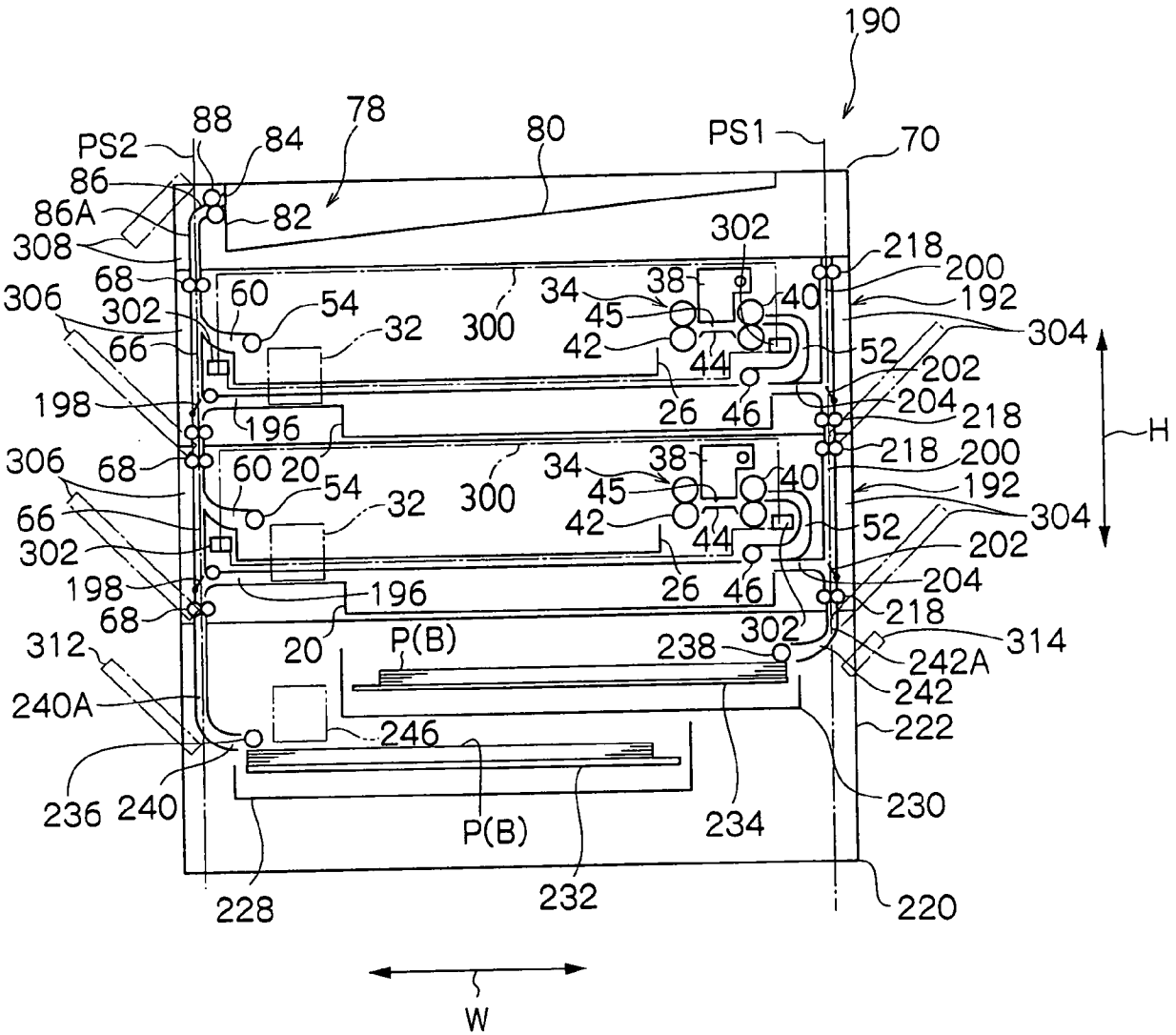
FIG. 12 is a side view showing structure of a printing apparatus relating to a fourth embodiment of the present invention and structures for performing jam processing and maintenance of a supply path and an ejection path.
Figure 13:
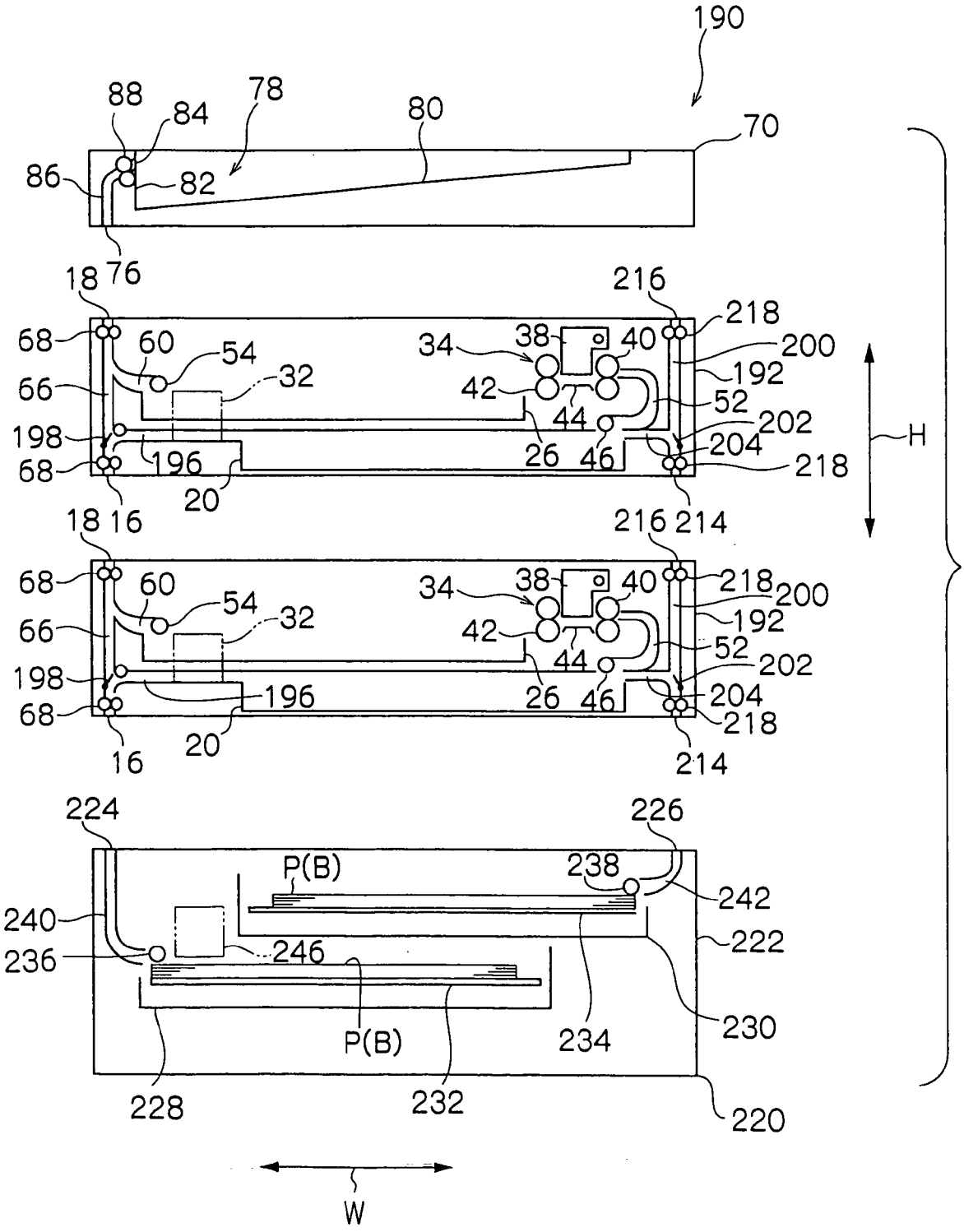
FIG. 13 is a side view showing a state in which the printing apparatus shown in FIG. 12 is broken up into unit pieces.
Figure 14:
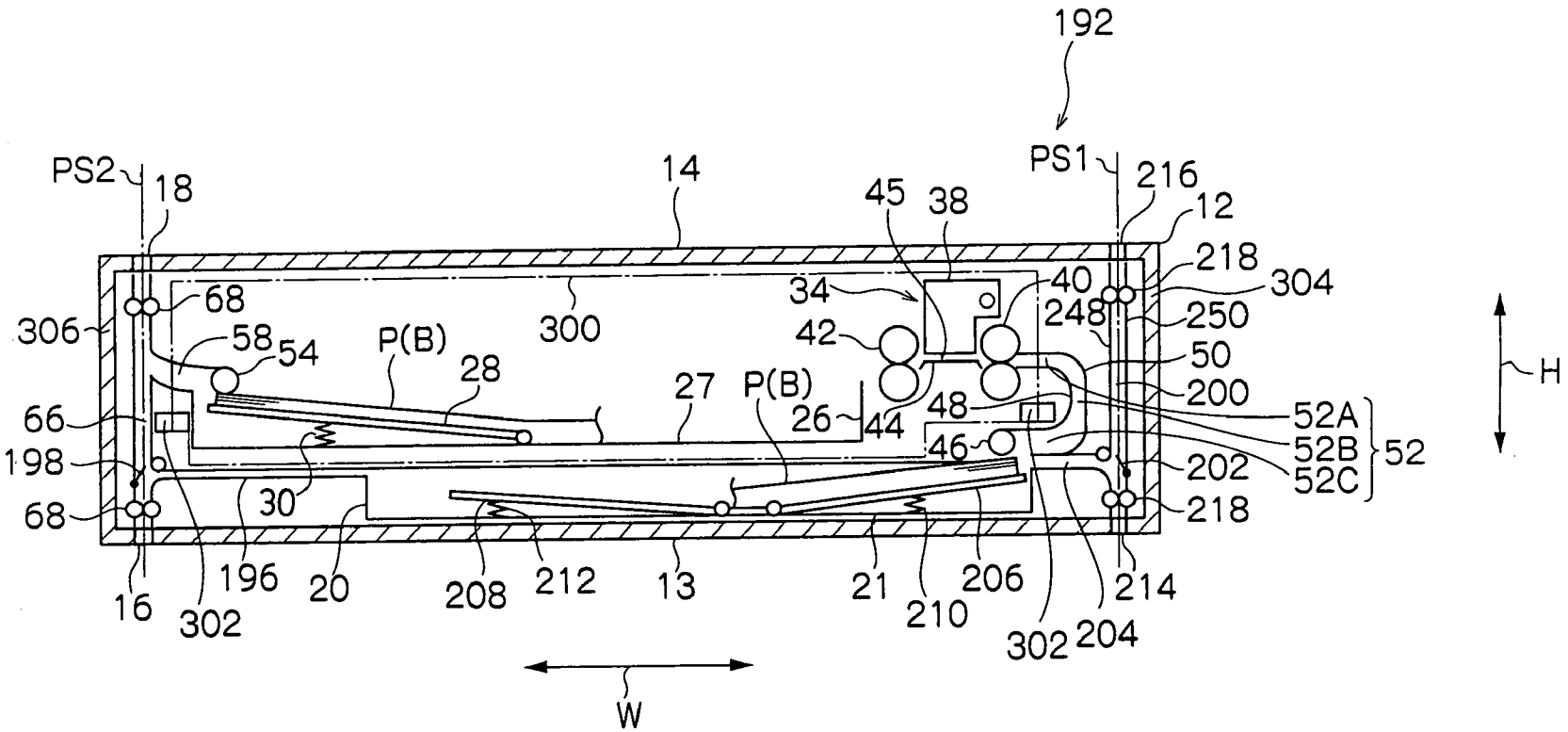
FIG. 14 is a side sectional view showing structure of a printing unit of the printing apparatus relating to the fourth embodiment of the present invention.

FIGS. 12 and 13 show a printing apparatus relating to a fourth embodiment of the present invention, and FIG. 14 shows a printing unit employed in the printing apparatus relating to the present embodiment. Note that for a printing apparatus 190 and a printing unit 192 relating to the present embodiment, portions that are common with those of the printing apparatus 72 and printing unit 10 relating to the first embodiment are assigned the same reference numerals, and descriptions thereof are omitted.

A respect in which the printing apparatus 190 relating to the present embodiment differs from the printing apparatus 72 relating to the first embodiment is that, as shown in FIG. 12, a paper supply unit 220 is disposed at a lower side of the printing unit 192 that is at the lowest level.

A further respect in which the printing unit 192 relating to the present embodiment differs from the printing unit 10 relating to the first embodiment is that, as shown in FIG. 14, a branching guide path 196 and a guide lever 198 are respectively provided in each printing unit 192. The branching guide path 196 joins the paper ejection guide path 66 with the paper supply hopper 20 in each printing unit 192, and the guide lever 198 is for selectively guiding recording paper P in the paper ejection guide path 66 into the branching guide path 196. Further, a paper supply guide path 200 is provided separately from the paper ejection guide path 66 in each printing unit 192, and a guide lever 202 and a branching guide path 204 are provided in each printing unit 192. The guide lever 202 is for selectively guiding recording paper P that is being conveyed through the paper supply guide path 200 into the paper supply hopper 20.

As shown in FIG. 14, a pair of stacking plates 206 and 208 are disposed adjacent to one another along the breadth direction on the bottom plate portion 21 in the paper supply hopper 20. Respective breadth direction central side end portions of these stacking plates 206 and 208 are swingably coupled to the bottom plate portion 21. Hence, a leading end side region of recording paper P (a paper bundle B) that is stored in the paper supply hopper 20 is placed on the stacking plate 206, and a trailing end side region of the same is placed on the stacking plate 208. Swinging end sides of the stacking plates 206 and 208 are respectively urged upward by urging members 210 and 212, such as coil springs or the like. Further, in the printing unit 192, the separation and supply roller 46 is disposed above the paper supply hopper 20 and the separation and supply roller 46 is supported so as to oppose a distal end portion of the stacking plate 206.

Actuators (not shown) are provided at the paper supply hopper 20 for moving the stacking plates 206 and 208 downward in the directions of swinging, against the urging members 210 and 212, and restraining the stacking plates 206 and 208 at lower limit positions thereof. When recording paper P is to be received into the paper supply hopper 20 from the branching guide path 196 or the branching guide path 204, these actuators swing and restrain the stacking plates 206 and 208 to the lower limit positions, which are each close to the bottom plate portion 21, and respectively release the pair of stacking plates 206 and 208 after reception of the recording paper P into the paper supply hopper 20 has been completed. Hence, the stacking plates 206 and 208 are swung upward by urging forces from the urging members 210 and 212 and a leading end portion of the recording paper P is pressed against the separation and supply roller 46. The actuators also swing and restrain the stacking plates 206 and 208 to the lower limit positions when the paper supply hopper 20 is being slid from the mounted position to the supply position.

As shown in FIG. 14, in the printing unit 192, the guide lever 198 is provided in the vicinity of a branching point of the paper ejection guide path 66 and the branching guide path 196. At the guide lever 198, a support axis portion, which is a center of swinging, is provided at one end portion of the guide lever 198. This support axis portion is axially supported by an axle portion (not shown), which is disposed at the one paper ejection guide plate 62. Here, the guide lever 198 is set to be rotatable in a range between a paper supply position, for guiding recording paper P into the branching guide path 196 from the paper ejection guide path 66, and a paper ejection position, for guiding recording paper P along the paper ejection guide path 66 toward the paper ejection unit 70. The guide lever 198 is coupled to a first rotary actuator (not shown), and is rotated and held at either of the paper supply position and the paper ejection position by this first rotary actuator.

A pair of paper supply guide plates 248 and 250, which extend in the height direction, are provided in the printing unit 192 at an end portion at an opposite side of the printing unit 192 from the paper ejection guide path 66 (i.e., a front end portion). A gap between these paper supply guide plates 248 and 250 serves as the slit-form paper supply guide path 200, which passes through the printing unit 192 in the height direction. At the casing 12 of the printing unit 192, as shown in FIG. 14, a slit-form paper supply aperture 214 and a slit-form paper ejection aperture 216 are formed in the bottom plate portion 13 and the top plate portion 14, respectively. The paper supply guide path 200 joins the paper supply aperture 214 with the paper ejection aperture 216 in the casing 12. Furthermore, conveyance roller pairs 218 are respectively provided at a lower end portion and an upper end portion of the paper supply guide path 200.

The branching guide path 204, which branches from the paper supply guide path 200 toward the paper supply hopper 20, is provided in the printing unit 192. A distal end portion of this branching guide path 204 opens into the paper supply hopper 20. Hence, recording paper P can be fed through the branching guide path 204 into the paper supply hopper 20 and the recording paper P can be stored in the paper supply hopper 20.

As shown in FIG. 14, in the printing unit 192, the guide lever 202 is provided in the vicinity of a branching point of the paper supply guide path 200 and the branching guide path 204. At the guide lever 202, a support axis portion, which is a center of swinging, is provided at one end portion of the guide lever 202. This support axis portion is axially supported by an axle portion (not shown), which is disposed at the one paper supply guide plate 250. Here, the guide lever 202 is set to be rotatable in a range between a paper supply position, for guiding recording paper P from the paper supply guide path 200 to the branching guide path 204, and a conveying position, for guiding recording paper P to the paper supply guide path 200 at the upper level side. The guide lever 202 is coupled to a second rotary actuator (not shown), and is rotated and held at either of the paper supply position and the conveying position by this second rotary actuator.

As mentioned above, the printing apparatus 190 is provided with the paper supply unit 220 at a lowermost level, and the printing apparatus 190 is structured by stacking the printing units 192 and the paper ejection unit 70 on this paper supply unit 220. Herein, the paper supply unit 220 is a unit for storing recording paper P and supplying this recording paper P into the paper supply hopper 20 of each printing unit 192.

As shown in FIG. 12, the paper supply unit 220 is provided with a casing 222, which serves as an outer shell portion. Sizes along the breadth direction and the depth direction of this casing 222 are substantially the same as those of the casing 12 of the printing unit 192. At the casing 222, a slit-form first paper discharge aperture 224 and a slit-form second paper discharge aperture 226 (see FIG. 13) are opened at a rear end side and a front end side, respectively, of an upper face portion of the casing 222. These paper discharge apertures 224 and 226 connect with the paper supply apertures 16 and 214, respectively, of the printing unit 192 that is adjacent to the paper supply unit 220 at the upper level side thereof.

A first main paper supply hopper 228, which is formed to be capable of storing a paper bundle B in which a number of sheets of the recording paper P are stacked, is provided inside the casing 222, and a second main paper supply hopper 230 is disposed upward of this first main paper supply hopper 228. These main paper supply hoppers 228 and 230 are each supported at the casing 222 to be slideable along the depth direction between a mounted position and a supply position. Here, when the main paper supply hopper 228 or 230 slides from the mounted position in the casing 222 to the supply position, an opening portion of an upper face side of the main paper supply hopper 228 or 230 is put into an open state, and recording paper P (a paper bundle B) can be supplied or taken out through this opening portion.

First and second stacking trays 232 and 234 and raising/lowering mechanisms (not shown) are provided in the main paper supply hoppers 228 and 230. The paper bundles B stored in the main paper supply hoppers 228 and 230 are stacked on the first and second stacking trays 232 and 234, respectively. The raising/lowering mechanisms support the first and second stacking trays 232 and 234 to be raiseable and lowerable in the height direction. First and second separation and supply rollers 236 and 238 are also provided in the casing 222, above the main paper supply hoppers 228 and 230, respectively. The first separation and supply roller 236 is supported such that a roller face thereof opposes a rear end portion of an upper face of the paper bundle B that is stacked on the first stacking tray 232, and the second separation and supply roller 238 is supported such that a roller face thereof opposes a front end portion of an upper face of the paper bundle B that is stacked on the second stacking tray 234.

In conjunction with sliding of the main paper supply hopper 228 or 230 from the mounted position to the supply position, the raising/lowering mechanism moves the stacking tray 232 or 234 to a lower limit position which is near a bottom plate portion of the main paper supply hopper 228 or 230. In conjunction with sliding of the main paper supply hopper 228 or 230 from the supply position to the mounted position, the raising/lowering mechanism lifts the stacking tray 232 or 234 and presses the paper bundle B on the stacking tray 232 or 234 against the separation and supply roller 236 or 238 with a predetermined pressing force.

As shown in FIG. 12, a first connection guide path 240 is provided in the casing 222. The first connection guide path 240 extends from the first paper discharge aperture 224 toward the first separation and supply roller 236. A distal end portion of this first connection guide path 240 opens to face the portion of the first separation and supply roller 236 that presses against the paper bundle B. Hence, when the first separation and supply roller 236 rotates to the extent of a predetermined amount, one sheet of recording paper P is separated from the paper bundle B on the first stacking tray 232 by the first separation and supply roller 236, and a leading end side of this recording paper P is fed into the first connection guide path 240.

A second connection guide path 242 is also provided in the casing 222. The second connection guide path 242 extends from the second paper discharge aperture 226 toward the second separation and supply roller 238. A distal end portion of this second connection guide path 242 opens to face the portion of the second separation and supply roller 238 that presses against the paper bundle B. Hence, when the second separation and supply roller 238 rotates to the extent of a predetermined amount, one sheet of recording paper P is separated from the paper bundle B on the second stacking tray 234 by the second separation and supply roller 238, and a leading end side of this recording paper P is fed into the second connection guide path 242.

Here, the stacking trays 232 and 234 provided in the main paper supply hoppers 228 and 230, respectively, are not limited to single trays. Pluralities of the stacking trays 232 and 234 may be provided in the main paper supply hoppers 228 and 230, respectively, with respectively different types of recording paper P being stacked in each stacking tray 232 or 234. In such a case, one type of recording paper P selected from the plurality of types of recording paper P can be fed into the respective connection guide path 240 or 242 by, for example, as well as moving the plurality of stacking trays 232 or 234 in the vertical direction with the raising/lowering mechanism, moving the plurality of stacking trays 232 or 234 in the front-rear direction (the breadth direction) to selectively press the paper bundle B stacked in any of the plurality of stacking trays 232 or 234 against the separation and supply roller 236 or 238.

A plurality of guide protrusions (not shown) are provided protruding upward at a top plate portion of the casing 222 of the paper supply unit 220. These guide protrusions are disposed to respectively correspond with a plurality of guide-receiving portions (not shown) of the printing unit 192. In the state in which the printing apparatus 190 is structured by stacking the printing units 192 and the paper ejection unit 70 on the paper supply unit 220, the guide protrusions of the paper supply unit 220 are inserted into the guide-receiving portions of the printing unit 192 at the upper level side thereof. Thus, the paper supply unit 220, the printing units 192 and the paper ejection unit 70 are positioned so as to align with one another along the breadth direction and the depth direction, and are integrated by movement between the units 70, 192 and 220 being restricted. Here, similarly to the printing unit 192, the paper supply unit 220 is provided with a control section 246, and this control section 246 is electrically connected with the other control sections 32 of the printing units 192.

At the printing apparatus 190 relating to the present embodiment too, simply by lifting up the units 70 and 192 at an upper level side, they can be easily separated from the units 192 and 220 at a lower level side, as shown in FIG. 13. Accordingly, if the printing apparatus 190 is put into a state in which one of the printing units 192 is separated from another of the printing units 192 or the paper ejection unit 70 is separated from the printing unit 192 at the lower level side thereof, it is possible to insert one or a number of the printing units 192 between the one printing unit 192 and the other printing unit 192 or between the printing unit 192 and the paper ejection unit 70, or to take out one or a number of the printing units 192 from between those printing units 192 or from between the printing unit 192 and the paper ejection unit 70. Thus, at the printing apparatus 190, the number of the printing units 192 that structure the device can be easily increased/reduced, and it is possible to adjust the printing capabilities of the device as a whole, including printing speeds, by increasing/reducing the number of printing units 192.

Next, structures for carrying out recording paper P jam processing and maintenance of the printing apparatus 190 provided with the printing units 192, the paper supply unit 220 and the paper ejection unit 70 of the present embodiment will be described using FIG. 12.

Structures for performing recording paper P jam processing and maintenance of the transport path and ejection path of each printing unit 192 of the printing apparatus 190 are basically the same as the structures for performing recording paper P jam processing and maintenance of the transport path and ejection path of each printing unit 10 of the printing apparatus 72 relating to the first embodiment. For the supply path, a structure is provided for recording paper P jam processing and maintenance at the paper supply guide path 200. This structure is basically the same as that at the ejection path side.

In the printing unit 192, the structure for performing recording paper P jam processing and maintenance of the transport path is a structure which is capable of sliding the transport path portion relative to the casing 12 of the printing unit 192 in the depth direction, which is the direction substantially intersecting the direction in which the transport path extends (the horizontal direction), between the mounted position (closed position) and the open position. This transport path portion, the same as in the first embodiment, includes the rear portion of the upper guide path portion 52C of the printing guide path 52, the sub-scanning guide path 45, the paper ejection buffer 26 and the front portion of the branch guide path 60. The transport path portion is assembled to the upper face side of the sliding panel 300, together with the printing section 34, the separation and ejection roller 54 and the like, which are also assembled to the upper face side of the sliding panel 300, and these members are formed into a unit. The front end portion and rear end portion of the sliding panel 300 are attached to the casing 12 via the pair of guide rails 302, and the sliding panel 300 is rendered slideable along the depth direction relative to the casing 12 by this pair of guide rails 302.

In the printing unit 192, the structure for performing recording paper P jam processing and maintenance of the paper supply guide path 200 is a structure at which the paper supply guide path 200 is made cleavable along the vertical direction. The opening/closing panel 304 is provided at the front face of the casing 12 of the printing unit 192, the paper supply guide path 200 is provided between the opening/closing panel 304 and the casing 12, and the paper supply guide path 200 is cleaved and opened by opening of the opening/closing panel 304.

In the printing unit 192, the structure for performing recording paper P jam processing and maintenance of the ejection path, which includes the paper supply course for the recording paper P from the first main paper supply hopper 228 of the paper supply unit 220 to the paper supply hopper 20, is a structure at which the ejection path (the paper ejection guide path 66) is made cleavable along the vertical direction. The same as in the first embodiment, the opening/closing panel 306 is provided at the rear face of the casing 12 of the printing unit 192, the ejection path including the aforementioned paper supply course is provided between the opening/closing panel 306 and the casing 12, and the ejection path is cleaved and opened by opening of the opening/closing panel 306.

Further, in the printing apparatus 190 of the present embodiment, structures for performing recording paper P jam processing and maintenance of the first connection guide path 240 and second connection guide path 242 of the paper supply unit 220 are also provided. These structures for performing recording paper P jam processing and maintenance of the connection guide paths 240 and 242 are basically the same as the structure for performing recording paper P jam processing and maintenance of the connection guide path 132 of the paper supply unit 104 relating to the third embodiment, and is a structure at which portions of the connection guide paths 240 and 242 are rendered cleavable along the vertical direction.

An opening/closing panel 312 is provided at the paper supply unit 220, at an upper end portion of a rear face of the casing 222. An upper connection guide path portion 240A, which is provided extending substantially vertically to structure an upper portion side of the first connection guide path 240, is provided between the opening/closing panel 312 and the casing 222. This upper connection guide path portion 240A, being a portion of the first connection guide path 240, is cleaved and opened by opening of the opening/closing panel 312.

An opening/closing panel 314 is also provided at the paper supply unit 220, at an upper end portion of a front face of the casing 222. An upper connection guide path portion 242A, which is provided extending substantially vertically to structure an upper portion side of the second connection guide path 242, is provided between the opening/closing panel 314 and the casing 222. This upper connection guide path portion 242A, being a portion of the second connection guide path 242, is cleaved and opened by opening of the opening/closing panel 314.

Next, operations by the printing apparatus 190 relating to the present embodiment, which is structured as described above, will be described.

Operations of recording images on recording paper P with each printing unit 192 of the printing apparatus 190 are basically common with operations of recording images on recording paper P with the printing apparatus 72 relating to the first embodiment, and descriptions thereof are omitted.

In the printing apparatus 190 of the present embodiment, because, compared to the printing apparatus 72 of the first embodiment, the paper supply unit 220 has been added, it is possible to supply recording paper P from the paper supply unit 220 into the paper supply hopper 20 of each printing unit 192. This operation of supply from the paper supply unit 220 to the paper supply hopper 20 will now be described.

If, in accordance with the volume of a print command from a data processing device, an amount of recording paper P remaining in the paper supply hopper 20 and the like, the control section 32 of the printing unit 192 judges that supply of recording paper P from the paper supply unit 220 is necessary, and judges that supply from the paper supply unit 220 is possible, the control section 32 prepares for receiving the recording paper P from the paper supply unit 220 and sends a request to the paper supply unit 220 for the supply of recording paper P. Here, cases in which the control section 32 judges that the supply of recording paper P from the paper supply unit 220 is necessary include a case in which the amount of recording paper P remaining in the paper supply hopper 20 is small and a case in which it is necessary, according to the print command, to record images on the recording paper P that is stored in the paper supply unit 220.

The control section 32 judges that the supply of recording paper P from the paper supply unit 220 to the paper supply hopper 20 is possible when image recording is not being carried out on recording paper P by the printing section 34 and the paper ejection guide path(s) 66 (the paper supply course) between the paper supply unit 220 and the paper supply hopper 20 is not occupied by recording paper P, or when image recording is not being carried out on recording paper P by the printing section 34 and the paper supply guide path(s) 200 between the paper supply unit 220 and the paper supply hopper 20 is not occupied by recording paper P.

Firstly, a case in which recording paper P is to be supplied from the first main paper supply hopper 228 of the paper supply unit 220 will be described.

When the control section 32 judges that the supply of recording paper P from the paper supply unit 220 is necessary and judges that supply from the paper supply unit 220 through the paper ejection guide path 66 is possible, first, the stacking plates 206 and 208 are respectively swung to the lower limit positions by the actuators and restrained, and the guide lever 198 is turned from the paper ejection position to the paper supply position by the rotary actuator.

Then, the control section 32 commences rotation of each conveyance roller pair 68 disposed at the paper ejection guide path(s) 66 between the paper supply unit 220 and the printing supply hopper 20 in respective predetermined feeding directions, and sends a first paper supply signal to the control section 246 of the paper supply unit 220. When the control section 246 of the paper supply unit 220 receives this first paper supply signal, the control section 246 rotates the first separation and supply roller 236 by a predetermined amount. In consequence, one sheet of recording paper P is separated from the paper bundle B stacked on the first stacking tray 232 and is fed into the first connection guide path 240. A leading end side of this recording paper P passes along the first connection guide path 240, is fed into the paper ejection guide path 66, and is nipped and conveyed by the conveyance roller pair(s) 68. When the recording paper P has been conveyed to the point of branching between the paper ejection guide path 66 and the branching guide path 196, the recording paper P is guided from the paper ejection guide path 66 into the branching guide path 196 by the guide lever 198. This recording paper P is discharged into the paper supply hopper 20 by conveyance force from the conveyance roller pair(s) 68, and is stored on the stacking plates 206 and 208.

If the control section 246 of the paper supply unit 220 is requested for a plurality of sheets of the recording paper P by the first paper supply signal from the control section 32, the control section 246 repeats the separation and paper supply operation, rotating the first separation and supply roller 236 to feed succeeding recording paper P into the first connection guide path 240 at the same time as preceding supplied recording paper P is being stored in the paper supply hopper 20, for the number of sheets of recording paper P that has been requested.

When the number of sheets of recording paper P requested by the first paper supply signal has been stored in the paper supply hopper 20, the control section 32 of the printing unit 192 releases the stacking plates 206 and 208 from their lower limit positions with the respective actuators, and returns the guide lever 198 from the paper supply position to the paper ejection position with the rotary actuator. Hence, in the printing unit 192, the recording paper P that has been supplied from the first main paper supply hopper 228 of the paper supply unit 220 can be supplied, with priority, from inside the paper supply hopper 20 to the printing section 34, and recording paper P that is fed into the paper ejection guide path 66 from the printing unit 192 can be conveyed to the paper ejection unit 70.

Next, a case in which recording paper P is to be supplied from the second main paper supply hopper 230 of the paper supply unit 220 will be described.

When the control section 32 of the printing unit 192 judges that the supply of recording paper P from the paper supply unit 220 is necessary and judges that supply from the paper supply unit 220 through the paper supply guide path 200 is possible, first, the stacking plates 206 and 208 are respectively swung to the lower limit positions by the actuators and restrained, and the guide lever 202 is rotated from the conveying position to the paper supply position by the rotary actuator.

Then, the control section 32 commences rotation of each of the conveyance roller pairs 218 that are disposed at the paper supply guide path(s) 200 between the paper supply unit 220 and the printing supply hopper 20 in respective predetermined conveyance directions, and sends a second paper supply signal to the control section 246 of the paper supply unit 220. When the control section 246 of the paper supply unit 220 receives this paper supply signal, the control section 246 rotates the second separation and supply roller 238 by a predetermined amount. In consequence, one sheet of recording paper P is separated from the paper bundle B stacked on the second stacking tray 234 and is fed into the second connection guide path 242. A leading end side of this recording paper P passes along the second connection guide path 242, is fed into the paper supply guide path 200, and is nipped and conveyed by the conveyance roller pair(s) 218. When the recording paper P has been conveyed to the point of branching between the paper supply guide path 200 and the branching guide path 204, the recording paper P is guided from the paper supply guide path 200 into the branching guide path 204 by the guide lever 202. This recording paper P is discharged through the branching guide path 204 into the paper supply hopper 20 by conveyance force from the conveyance roller pair(s) 218, and is stored on the stacking plates 206 and 208.

If the control section 246 of the paper supply unit 220 has been requested for a plurality of sheets of the recording paper P by the second paper supply signal from the control section 32, the control section 246 repeats the separation and paper supply operation, rotating the second separation and supply roller 238 to feed succeeding recording paper P into the second connection guide path 242 at the same time as previously supplied recording paper P is being stored in the paper supply hopper 20, for the number of sheets of recording paper P that has been requested.

When the number of sheets of recording paper P requested by the second paper supply signal has been stored in the paper supply hopper 20, the control section 32 of the printing unit 192 releases the stacking plates 206 and 208 from the lower limit positions with the respective actuators, and returns the guide lever 202 from the paper supply position to the conveying position with the rotary actuator. Hence, in the printing unit 192, the recording paper P that has been supplied from the second main paper supply hopper 230 of the paper supply unit 220 can be supplied, with priority, from inside the paper supply hopper 20 to the printing section 34, and recording paper P that is fed into the paper ejection guide path 66 from the printing unit 192 can be conveyed to the paper ejection unit 70.

Next, operations of the printing unit 192 and printing apparatus 190 relating to the present embodiment as described above will be described.

According to the printing unit 192 and printing apparatus 190 relating to the present embodiment, the same effects as with the printing unit 10 and printing apparatus 72 relating to the first embodiment can be obtained, in that capabilities of printing on the recording paper P can be improved and printing capabilities, including printing speed, can be adjusted in broad ranges in correspondence with the number of the printing units 192.

Furthermore, with the printing unit 192 relating to the present embodiment, it is possible to supply recording paper P supplied from the paper supply unit 220 into the paper supply hopper 20 of the printing unit 192 through either of the paper ejection guide path 66 and the paper supply guide path 200. Therefore, even when, for example, the paper ejection guide path 66 is occupied by image-recorded recording paper P, it is possible to supply recording paper P from the paper supply unit 220 to any printing unit 192 that is not recording images on recording paper P, and even when recording paper P is being supplied to one of the printing units 192 through the paper supply guide path(s) 200, it is possible to supply recording paper P to another of the printing units 192 through the paper ejection guide path(s) 66. Therefore, in comparison with the printing apparatuses 72 and 100 that use the printing units 10 and 102 relating to the first and third embodiments, amounts of time for which the device is stopped in order to wait for completion of supplies of recording paper P from the paper supply unit 220 to the printing units 192 can be reduced, and amounts of time for supplying recording paper P to the plurality of printing units 192 can be shortened.

In the printing apparatus 190, the paper supply hopper 20 is provided in the printing unit 192 and the two main paper supply hoppers 228 and 230 are provided in the paper supply unit 220. Therefore, it is possible to select a required recording paper P from a greater number of kinds of recording paper P than in the printing apparatuses 72 and 100 relating to the first and third embodiments and automatically record images on this recording paper P with the printing section 34 of the printing unit 192.

At the printing apparatus 190, similarly to the printing apparatus 100 of the third embodiment, the printing apparatus 190 is structured by arranging and stacking the plurality of printing units 192, the paper supply unit 220 and the paper ejection unit 70 in a vertical direction. Therefore, in comparison with, for example, a device which is structured by disposing a storage section and/or ejection section for recording paper P to a side relative to the printing units 192, the footprint of the printing apparatus can be made smaller.

Further, at the printing apparatus 190, the main paper supply hoppers 228 and 230, which collectively store common recording paper P which can be supplied to the plurality of printing units 192, are provided at the paper supply unit 220 which is disposed at a lowermost level. Weight of the paper supply unit 220 is increased in a state in which large numbers of sheets of recording paper P are stored in the main paper supply hoppers 228 and 230. Because this paper supply unit 220, which is a heavy portion, is disposed at a lower portion of the printing apparatus 190, stability and durability of the printing apparatus as a whole can be improved.

At each printing unit 192, if, in a printing operation, recording paper P becomes jammed during printing or while being fed in the transport path, processing of this jam can be performed with ease by sliding the transport path portion, which includes the rear portion of the upper guide path portion 52C of the printing guide path 52, the sub-scanning guide path 45, the paper ejection buffer 26 and the front portion of the branch guide path 60. Furthermore, because the inkjet head 38, the nipping roller pair 40, the roller pair 42 and the separation and ejection roller 54 are drawn out together with the transport path portion that includes the paper ejection buffer 26 and the like by this sliding, maintenance such as supplying ink to the inkjet head 38, maintaining the actuator that drives the stacking plate 28 of the paper ejection buffer 26 and the like, and maintenance such as cleaning or replacing the respective rollers and the like, can be carried out with ease.

At each printing unit 192, if recording paper P becomes jammed in the paper supply guide path 200, processing of this jam can be carried out with ease by opening the opening/closing panel 304 which is openably/closeably attached to the casing 12 of the printing unit 192.

At each printing unit 192, jam processing of a case in which recording paper P becomes jammed in the ejection path during a printing operation can be carried out with ease by opening the opening/closing panel 306 which is openably/closeably attached to the casing 12 of the printing unit 192.

Even in a case in which jammed recording paper P is disposed to straddle between the ejection path and the transport path or suchlike, it is possible to deal with the jam by opening the opening/closing panel 306, without sliding the transport path portion. Therefore, the recording paper P that is disposed to straddle between the ejection path and the transport path will not be damaged by sliding of the transport path portion such that removal of a torn-off piece of the paper which is left at the ejection path side becomes more difficult. Moreover, damage to the interior of the printing unit 192, the separation and ejection roller 54 or the like by tensile forces acting through the recording paper P in accordance with such sliding can be prevented.

Because it is possible to cleave the supply path (the paper supply guide path 200) and the ejection path (the paper ejection guide path 66) thus, maintenance operations such as cleaning the interior of the supply path and the interior of the ejection path, cleaning or replacement of the conveyance roller pairs 218 and the guide lever 202 provided at the paper supply guide path 200, cleaning or replacement of the conveyance roller pairs 68 and the guide lever 198 provided at the paper ejection guide path 66, and the like can also be carried out with ease.

In the present embodiment, jam processing of recording paper P that has jammed in the connection guide path 240 or 242 of the paper supply unit 220 and maintenance operations, such as cleaning of the interior of the connection guide path 240 or 242 and the like, can be carried out with ease by opening the opening/closing panel 312 or 314 which is openably/closeably attached to the casing 222 of the paper supply unit 220.

Fifth Embodiment

In the printing apparatuses used for the descriptions of the first to fourth embodiments hereabove, a printing section, a storage section and an ejection section are unit-structured as a printing unit, a paper supply unit and a paper ejection unit, which are respectively separable. However, the present invention is not limited to such unit structures, and can also be applied to, for example, an integrated-type printing apparatus in which a plurality of printing sections and pluralities of storage sections and ejection sections are arranged in a vertical direction inside a single casing body, image-recording is parallel-processed on a plurality of recording mediums by supplying the recording mediums from the plurality of storage sections to the plurality of printing sections and operating in a parallel manner, and the plurality of recording mediums on which images have been recorded are ejected to the ejection sections.

Figure 15:
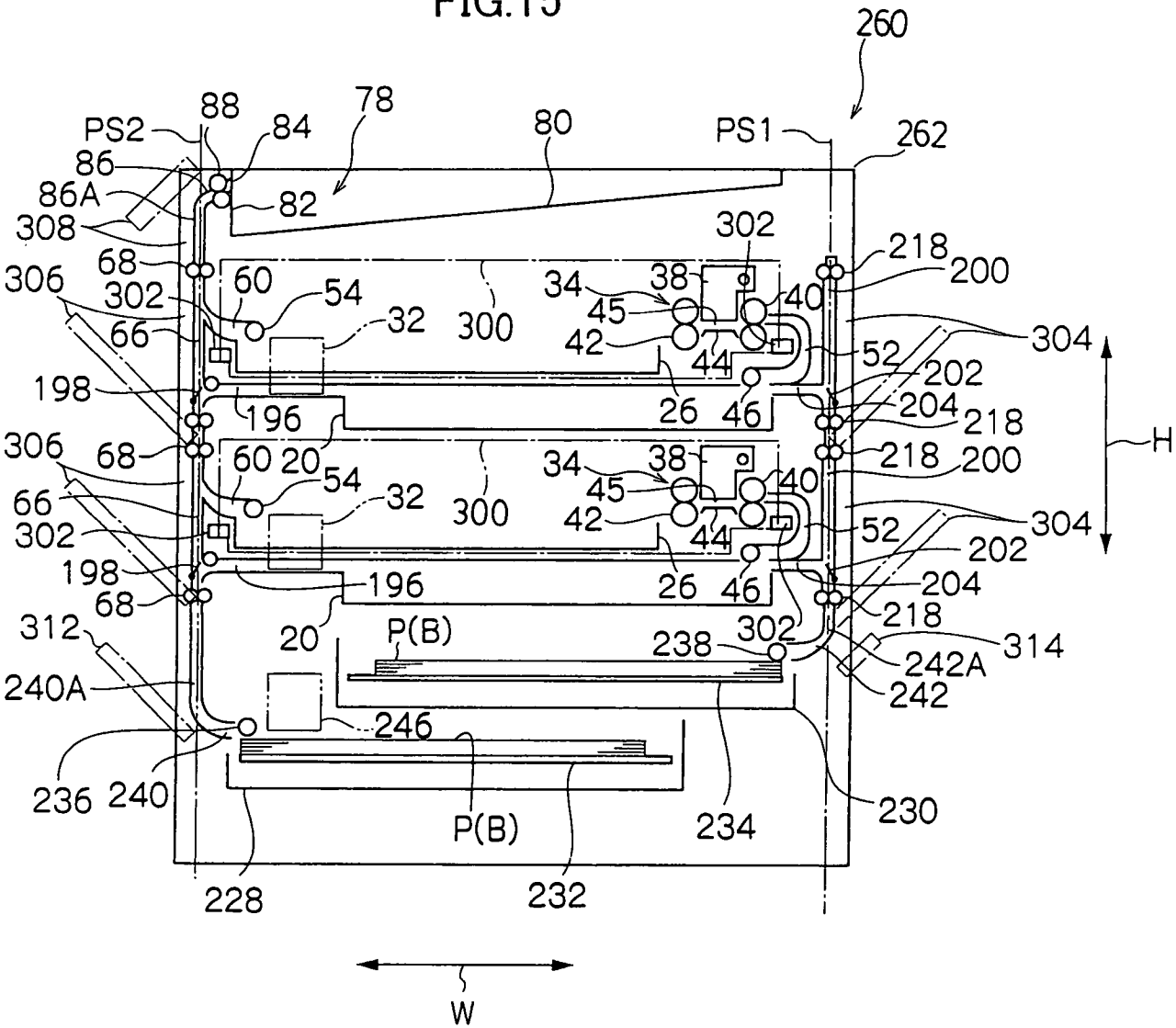
FIG. 15 is a side view showing structures for performing jam processing and maintenance of a supply path and an ejection path of a printing apparatus relating to a fifth embodiment of the present invention.

In a printing apparatus 260 relating to a fifth embodiment of the present invention, which is shown in FIG. 15, two of the printing section 34, two of the paper supply hopper 20, and the two main paper supply hoppers 228 and 230 are provided in a single casing 262 which structures a printing apparatus main body. The paper supply hoppers 20 are provided in respective correspondence with the two printing sections 34. The main paper supply hoppers 228 and 230 collectively store common recording paper P which can be supplied to the two printing sections 34 (the paper supply hoppers 20). The paper ejection tray portion 78 is provided at an upper portion of the casing 262. These sections are arranged in a vertical direction and structured in an integral form. Apart from the plurality of printing sections 34, the plurality of paper supply hoppers 20, the main paper supply hoppers 228 and 230 and the paper ejection tray portion 78 being integrated in the casing 262, the printing apparatus 260 of the present embodiment has the same structure as the printing apparatus 190 relating to the fourth embodiment. With this integrated-form printing apparatus 260, the same operations and effects as in the fourth embodiment are obtained.

At the printing section 34 of the printing apparatuses 72, 90, 100, 190 and 260 relating to the embodiments of the present invention, the inkjet head 38 is driven in the main scanning direction during image-recording while ink is being jetted from the nozzles of the inkjet head 38 to form an image on the recording paper P. However, at the printing section 34, beside the driving-type inkjet head 38, it is also possible to record on the recording paper P with a full-size fixed-type inkjet head, which has a width in the main scanning direction wider than the recording paper P. Furthermore, although examples in which an inkjet system is used for the printing section have been described for the embodiments of the present invention, the printing section is not limited thus. For example, it is possible to apply various printing sections according to other systems, such as, for example, a fusion-type thermal transfer system, a sublimation-type thermal transfer system, a dot impact system, an electrophotographic system or the like, and the invention is not limited by the printing section.

With regard to the supply path and the ejection path, beside the embodiments of the present invention, it is possible to embody structures of numerous variant examples based on the embodiments of the present invention, such as, for example, a structure in which a plurality of supply paths are provided, a structure in which a plurality of ejection paths are provided, and the like. The present invention can be applied to any printing apparatus structure, by a structure which includes: a supply path-cleaving portion, at which at least a portion of a supply path is rendered cleavable along a vertical direction and the supply path can be set between a through-path formation state, in which guidance of a recording medium by the at least a portion of the supply path is possible, and a through-path opening state, in which extraction of a recording medium that is present in the supply path is possible; and an ejection path-cleaving portion, at which at least a portion of an ejection path is rendered cleavable along a vertical direction and the ejection path can be set between a through-path formation state, in which guidance of a recording medium by the at least a portion of the ejection path is possible, and a through-path opening state, in which extraction of a recording medium that is present in the ejection path.

Furthermore, in the first to fifth embodiments of the present invention, descriptions of the embodiments have been given for examples of printing apparatuses with structures in each of which buffer portions (paper ejection buffers) are provided. However, a transport path structure that includes a sliding portion which is made slideable in a direction substantially intersecting a direction in which the transport path extends and the above-described cleavable structures of the supply path and ejection path, which are features of the present invention, may be applied to recording medium jam processing and maintenance processes of a parallel processing printing apparatus which is structured with a plurality of printing sections, a storage section and a paper ejection section arranged in a vertical direction, regardless of whether paper ejection buffers are present or not.

The present invention may be provided with: a supply path-cleaving portion which renders at least a portion of the supply path cleavable along a vertical direction, for setting the at least a portion of the supply path between a through-path formation state, which enables guidance of the recording mediums by the supply path, and a through-path opening state, which enables extraction of a recording medium that is disposed at the supply path; and an ejection path-cleaving portion which renders at least a portion of the ejection path cleavable along a vertical direction, for setting the at least a portion of the ejection path between a through-path formation state, which enables guidance of the recording mediums by the ejection path, and a through-path opening state, which enables extraction of a recording medium that is disposed at the ejection path.

With such a structure, if a recording medium becomes jammed in the supply path during a printing operation of the printing apparatus, processing of this jam can be performed by cleaving the at least a portion of the supply path. Here, the at least a portion of the supply path is made capable of dividing along the vertical direction by the supply path-cleaving portion. By this cleaving, the at least a portion of the supply path can be set to the through-path formation state, which enables guidance of the recording medium by the supply path, or the through-path opening state, which enables extraction of a recording medium disposed in the supply path. Accordingly, when the at least a portion of the supply path is cleaved along the vertical direction, from the through-path formation state to the through-path opening state, the recording medium jammed in the supply path is exposed and a user or the like can perform processing of this jam with ease.

Moreover, even in a case in which a jammed recording medium is disposed to straddle between the supply path and the printing section (the transport path), jam processing can be done simply by cleaving the at least a portion of the supply path, without sliding the at least a portion of the transport path. Therefore, the recording medium which is disposed extending between the supply path and the printing section will not be damaged by sliding of the at least a portion of the transport path, there will be no difficulty of removal of a torn-off piece of medium left at the supply path side, and damage to the device interior, the printing section and the like by tensile forces acting through the recording medium in accordance with such sliding can be avoided.

Jam processing when a recording medium becomes jammed in the ejection path can be performed by cleaving the at least a portion of the ejection path. Here, the at least a portion of the ejection path is made capable of dividing along the vertical direction by the ejection path-cleaving portion. By this cleaving, the at least a portion of the ejection path can be set to the through-path formation state, which enables guidance of the recording medium by the ejection path, or the through-path opening state, which enables extraction of a recording medium disposed in the ejection path. Accordingly, when the at least a portion of the ejection path is cleaved along the vertical direction, from the through-path formation state to the through-path opening state, the recording medium jammed in the ejection path is exposed and a user or the like can perform processing of this jam with ease.

Moreover, even in a case in which a jammed recording medium is disposed to straddle between the ejection path and the printing section (the transport path), jam processing can be done simply by cleaving the at least a portion of the ejection path, without sliding the at least a portion of the transport path. Therefore, the recording medium which is disposed extending between the ejection path and the printing section will not be damaged by sliding of the at least a portion of the transport path, there will be no difficulty of removal of a tom-off piece of medium left at the ejection path side, and damage to the device interior, the printing section and the like by tensile forces acting through the recording medium in accordance with such sliding can be avoided.

Further, because the at least a portion of the supply path and the at least a portion of the ejection path can be cleaved in this manner, maintenance operations, such as cleaning or replacing feed rollers provided in the supply path or ejection path and the like, can be carried out with ease.

In the printing apparatus of the present invention, the sliding portion may include a guide rail provided between a casing body, which structures a main body of the printing apparatus, and the at least a portion of the transport path for rendering the at least a portion of the transport path slideable relative to the casing body.

When such a guide rail is used, the at least a portion of the transport path is made slideable relative to the casing by the guide rail which is provided between the at least a portion of the transport path and the casing that structures the main body of the printing apparatus. Because this guide rail is used at the sliding portion, the at least a portion of the transport path can slide smoothly and operability thereof is excellent. Further, it is simple to provide, for example, a stopper or the like so as to prevent the at least a portion of the transport path which has been drawn out to the through-path opening position from bring drawn out further. Consequently, drawing out of the at least a portion of the transport path beyond a range of support of the guide rail, such that the at least a portion of the transport path accidentally falls down and is damaged, can be avoided.

In this printing apparatus, a buffer section may be provided at the at least a portion of the transport path for temporarily retaining a recording medium on which an image has been recorded by the printing section.

Because, when the buffer section is provided, a recording medium on which an image has been recorded by the printing section is temporarily retained by the buffer section provided at the at least a portion of the transport path, even if ejection to the ejection section of the recording medium on which the image has been recorded is not commenced immediately, the next recording medium can be supplied to the printing section and image formation by the printing section on this recording medium can be commenced. Therefore, even at, for example, a time at which the ejection path is occupied during ejection of a recording medium on which an image has been recorded by another printing section, it is not necessary to interrupt operations of recording images on recording mediums at the rest of the printing sections, and the recording medium temporarily retained in the buffer section can subsequently commence ejection at a time when ejection of this recording medium has become ready to start. Thus, the recording mediums on which images have been recorded can be ejected to the ejection section without being influenced by the recording operations by the printing sections, and throughput of the printing apparatus can be improved.

Further, when the at least a portion of the transport path is slid from the through-path formation position to the through-path opening position in response to a recording medium jam that has occurred in the buffer section, the buffer section and the recording medium jammed in the buffer section are drawn out together with the at least a portion of the transport path. Therefore, processing of this jam can be carried out with ease. Furthermore, maintenance operations of the buffer section can be carried out with ease by drawing out the buffer section together with the at least a portion of the transport path.

In the present printing apparatus, the buffer section may include: a buffer storage portion which stores one or more of the recording mediums on which images have been recorded by the printing section; and a separation and ejection portion, which separates the recording mediums stored in the buffer storage portion one at a time and feeds the separated recording mediums to the ejection path.

With this structure, numerous sheets of the recording medium on which images have been recorded by the printing section are stored in the buffer storage portion, and the recording mediums stored in the buffer storage portion are separated one by one and fed out to the ejection path by the separation and ejection section. In such a case, even if, for example, the ejection path is occupied for a long time during ejection of a recording medium on which an image has been recorded by another printing section, the rest of the printing sections is capable of continuing image-recording operations on numerous sheets of the recording medium.

In this printing apparatus, the at least a portion of the supply path may be provided between the supply path-cleaving portion and the casing body which structures the main body of the printing apparatus, with the supply path-cleaving portion being openably and closeably attached to the casing body, and the supply path-cleaving portion including a plurality of opening and closing panels which, by opening, individually cleave at least portions of the supply path, which are respectively provided in correspondence with the plurality of printing sections.

With such a structure, the at least a portion of the supply path is provided between the casing that structures the printing apparatus main body and the supply path-cleaving portion, and the supply path-cleaving portion is structured by the plurality of opening/closing panels which are openably/closeably mounted to the casing. When this plurality of opening/closing panels are respectively opened, the at least portions of the supply path which are respectively provided in correspondence with the plurality of printing sections are individually cleaved.

When such a plurality of opening/closing panels is present, for jam processing or maintenance operations of the respective supply paths provided in correspondence with the plurality of printing sections, jam processing is carried out by, for example, opening only the opening/closing panel corresponding to the supply path at which the jam has occurred and maintenance operations are carried out by, for example, opening only the opening/closing panels that correspond with locations requiring maintenance. In parallel with such operations, the supply of recording mediums to printing sections that use the supply paths that are in the through-path formation state, due to the other opening/closing panels being in a closed state, and image recording on those recording mediums by the printing sections are possible. Therefore, such jam processing and maintenance operations can be carried out with reductions in throughput of the printing apparatus being suppressed.

In this printing apparatus, the at least a portion of the supply path may be provided between the supply path-cleaving portion and the casing body which structures the main body of the printing apparatus, with the supply path-cleaving portion being provided to be mountable at and removable from the casing body, and the supply path-cleaving portion including a single mountable and removable panel which, by detaching, cleaves the at least portions of the supply path, which are respectively provided in correspondence with the plurality of printing sections, all together.

With such a structure, the at least a portion of the supply path is provided between the casing that structures the printing apparatus main body and the supply path-cleaving portion, and the supply path-cleaving portion is structured by the single mountable/removable panel which is mountably and removably attached to the casing. When this mountable/removable panel is detached from the casing, the at least portions of the supply path which are respectively provided in correspondence with the plurality of printing sections are cleaved all at once.

When such a single mountable/removable panel is present, for jam processing of the respective supply paths provided in correspondence with the plurality of printing sections, a recording medium that is, for example, disposed so as to straddle between a plurality of these supply paths will be found and removed with ease, and a plurality of recording mediums that are jammed at a plurality of locations of these supply paths will be found and removed with ease. Furthermore, because the respective at least portions of the supply path are cleaved and exposed all together simply by detachment of the single mountable/removable panel, operability when performing maintenance of each supply path at one time is excellent.

In this printing apparatus, the at least a portion of the ejection path may be provided between the ejection path-cleaving portion and the casing body which structures the main body of the printing apparatus, with the ejection path-cleaving portion being openably and closeably attached to the casing body, and the ejection path-cleaving portion including a plurality of opening and closing panels which, by opening, individually cleave at least portions of the ejection path, which are respectively provided in correspondence with the plurality of printing sections.

With such a structure, the at least a portion of the ejection path is provided between the casing that structures the printing apparatus main body and the ejection path-cleaving portion, and the ejection path-cleaving portion is structured by the plurality of opening/closing panels which are openably/closeably mounted to the casing. When this plurality of opening/closing panels are respectively opened, the at least portions of the ejection path which are respectively provided in correspondence with the plurality of printing sections are individually cleaved.

When such a plurality of opening/closing panels is present, for jam processing or maintenance operations of the respective ejection paths provided in correspondence with the plurality of printing sections, jam processing is carried out by, for example, opening only the opening/closing panel corresponding to the ejection path at which the jam has occurred and maintenance operations are carried out by, for example, opening only the opening/closing panels that correspond with locations requiring maintenance. In parallel with such operations, the ejection of image-recorded recording mediums to the ejection section from the printing sections that use the ejection paths that are in the through-path formation state, due to the other opening/closing panels being in a closed state, and image recording on those recording mediums by the printing sections are possible. Therefore, such jam processing and maintenance operations can be carried out with reductions in throughput of the printing apparatus being suppressed.

In this printing apparatus, the at least a portion of the ejection path may be provided between the ejection path-cleaving portion and the casing body which structures the main body of the printing apparatus, with the ejection path-cleaving portion being provided to be mountable at and removable from the casing body, and the ejection path-cleaving portion including a single mountable and removable panel which, by detaching, cleaves the at least portions of the ejection path, which are respectively provided in correspondence with the plurality of printing sections, all together.

With such a structure, the at least a portion of the ejection path is provided between the casing that structures the printing apparatus main body and the ejection path-cleaving portion, and the ejection path-cleaving portion is structured by the single mountable/removable panel which is mountably and removably attached to the casing. When this mountable/removable panel is detached from the casing, the at least portions of the ejection path which are respectively provided in correspondence with the plurality of printing sections are cleaved all at once.

When such a single mountable/removable panel is present, for jam processing of the respective ejection paths provided in correspondence with the plurality of printing sections, a recording medium that is, for example, disposed so as to straddle between a plurality of these ejection paths will be found and removed with ease, and a plurality of recording mediums that are jammed at a plurality of locations of these ejection paths will be found and removed with ease. Furthermore, because the respective at least portions of the ejection path are cleaved and exposed all together simply by detachment of the single mountable/removable panel, operability when performing maintenance of each ejection path at one time is excellent.

In the present printing apparatus, the at least one storage section may include a plurality of dedicated storage portions provided in respective correspondence with the plurality of printing sections.

With this structure, because the plurality of dedicated storage portions respectively corresponding to the plurality of printing sections are provided, recording mediums can be supplied in parallel from this plurality of dedicated storage portions to the plurality of printing sections. Therefore, in a case in which the plurality of printing sections are operated in a parallel manner and image recording on the recording mediums is parallel-processed, a supply rate of the recording mediums to the respective printing sections can be improved in comparison to, for example, a case of sequential supply of recording mediums to the plurality of printing sections from a single storage section, and throughput of the printing apparatus can be improved.

In the present printing apparatus, the printing apparatus may include a plurality of printing units, which are individually provided with each of the plurality of printing sections, and is structured by stacking the plurality of printing units.

With such a structure, the printing apparatus is structured by stacking the plurality of printing units which are individually provided with each of the plurality of printing sections. With this printing apparatus, it is possible to increase/reduce the printing rate of the apparatus as a whole (the number of sheets of recording medium on which images can be recorded per unit of time) by increasing/reducing the number of printing units. Thus, printing capabilities, including printing speeds, can be adjusted within a broad range in accordance with the requirements of users. Furthermore, if these printing units have a structure which is provided with the aforementioned buffer section at the at least a portion of the transport path, for each printing unit, even at a time at which ejection of a recording medium could be commenced immediately but the ejection path is occupied by a recording medium ejected from another printing unit, the recording medium on which an image has been recorded by the printing section of the each printing unit is temporarily retained by the buffer section, so interruption of image-recording operations on recording mediums by the printing section is not necessary. Therefore, even when the number of printing units is increased, there is very little reduction in printing capabilities due to increases in waiting times. Thus, when the number of printing units is increased, the printing capabilities can be effectively increased in correspondence with the increase in the number of units.

In this printing apparatus, the at least one storage section may include a common storage portion, which collectively stores common recording mediums which can be supplied to the plurality of printing sections, and a supply unit equipped with this common storage portion may be stacked with the plurality of printing units, being disposed at a lowermost level.

With this structure, the printing apparatus is structured by stacking the plurality of printing units and the supply unit, and the supply unit is disposed at the lowest level of this printing apparatus. Because this supply unit is provided with the common storage portion which collectively stores the common supply mediums which can be supplied to the plurality of printing sections, weight of the supply unit is increased in a state in which the recording mediums are stored in the common supply portion. Because this supply unit, which constitutes a weight portion, is disposed at a lower portion of the printing apparatus, stability and durability of the printing apparatus as a whole can be improved.

In this printing apparatus, the at least one ejection section may include an accumulation ejection portion, at which the recording mediums on which images have been recorded by the plurality of printing sections are accumulated, and an ejection unit equipped with this accumulation ejection portion may be stacked with the plurality of printing units, being disposed at an uppermost level.

With such a structure, the printing apparatus is structured by stacking the plurality of printing units and the ejection unit, the ejection unit is disposed at the topmost level of this printing apparatus, and the accumulation ejection portion which collects the recording mediums on which images have been recorded by the plurality of printing sections is provided at the ejection unit. Consequently, users can more easily remove image-recorded recording mediums, which have been collected at the accumulation ejection portion, from the accumulation ejection portion which is disposed at the upper portion of the printing apparatus than in, for example, a case in which an accumulation ejection portion is disposed at a lower portion of the printing apparatus or a case in which ejection sections are individually provided in correspondence with the plurality of printing sections.

Thus, in the present invention, the printing apparatus which supplies recording mediums to the plurality of printing sections, which are arranged in the vertical direction, and performs parallel processing of image recording on a plurality of the recording mediums by operating in a parallel manner is structured, and recording medium jam processing and maintenance operations can be carried out with ease. Further, if a recording medium that has become jammed is disposed to straddle between the supply path and a printing section or between a printing section and the ejection path, or if a recording medium that has become jammed is disposed to straddle between a plurality of the printing units which are individually equipped with the plurality of printing sections, the device will not be damaged by processing of such jams.

What is claimed is:

1. A printing apparatus comprising:

a plurality of printing sections, which record images on sheet-form recording mediums;

at least one storage section, which stores recording mediums to be supplied to the plurality of printing sections;

at least one ejection section, at which the recording mediums on which images have been recorded by the plurality of printing sections are ejected, wherein the printing sections, the storage section and the ejection section being arranged in a vertical direction, the recording mediums being supplied from the at least one storage section to the plurality of printing sections, and image-recording on a plurality of the recording mediums being processed in parallel by operating in a parallel manner, and the plurality of recording mediums on which images have been recorded being ejected to the at least one ejection section;

a supply path which extends in a vertical direction for guiding recording mediums that have been fed out from the storage section toward the printing sections;

a supply section which feeds out the recording mediums stored in the storage section to the supply path;

an ejection path which extends in a vertical direction for guiding the recording mediums on which images have been recorded by the printing sections toward the ejection section;

an ejection portion which ejects recording mediums that have been fed out to the ejection path to the ejection section;

a plurality of transport paths which are provided in correspondence with the plurality of printing sections and each extend in a horizontal direction with one end connecting with the supply path and other end connecting with the ejection path, for guiding recording mediums that have been fed in from the supply path to the printing section and feeding out the recording mediums on which images have been recorded by the printing section to the ejection path;

a plurality of sliding portions which, at each of the plurality of transport paths, render at least a portion of the transport path slidable, together with the printing section, in a direction substantially intersecting the direction in which the transport path extends, and which move the at least a portion of the transport path between a through-path formation position, capable of guiding of the recording medium by the transport path, and a through-path opening position, capable of extracting of a recording medium that is disposed at the transport path; and a buffer section which is provided at the at least a portion of the transport path for temporarily retaining a recording medium on which an image has been recorded by the printing section.

2. The printing apparatus of claim 1, wherein the buffer section comprises: a buffer storage portion which stores one or more of the recording mediums on which images have been recorded by the printing section; and a separation and ejection portion which separates the recording mediums stored in the buffer storage portion one at a time and feeds the separated recording mediums to the ejection path.

3. A printing apparatus comprising:

a plurality of printing sections, which record images on sheet-form recording mediums;

at least one storage section, which stores recording mediums to be supplied to the plurality of printing sections;

at least one ejection section, at which the recording mediums on which images have been recorded by the plurality of printing sections are ejected, wherein the printing sections, the storage section and the ejection section being arranged in a vertical direction, the recording mediums being supplied from the at least one storage section to the plurality of printing sections, and image-recording on a plurality of the recording mediums being processed in parallel by operating in a parallel manner, and the plurality of recording mediums on which images have been recorded being ejected to the at least one ejection section;

a supply path which extends in a vertical direction for guiding recording mediums that have been fed out from the storage section toward the printing sections;

a supply section which feeds out the recording mediums stored in the storage section to the supply path;

an ejection path which extends in a vertical direction for guiding the recording mediums on which images have been recorded by the printing sections toward the ejection section;

an ejection portion which ejects recording mediums that have been fed out to the ejection path to the ejection section;

a plurality of transport paths which are provided in correspondence with the plurality of printing sections and each extend in a horizontal direction with one end connecting with the supply path and other end connecting with the ejection path, for guiding recording mediums that have been fed in from the supply path to the printing section and feeding out the recording mediums on which images have been recorded by the printing section to the ejection path; and a plurality of sliding portions which, at each of the plurality of transport paths, render at least a portion of the transport path slidable, together with the printing section, in a direction substantially intersecting the direction in which the transport path extends, and which move the at least a portion of the transport path between a through-path formation position, capable of guiding of the recording medium by the transport path, and a through-path opening position, capable of extracting of a recording medium that is disposed at the transport path;

wherein the at least one storage section comprises a plurality of dedicated storage portions provided in respective correspondence with the plurality of printing sections.

* * * * *